US009389037B2

(12) United States Patent
Reynolds

(10) Patent No.: US 9,389,037 B2
(45) Date of Patent: Jul. 12, 2016

(54) TWO-STAGE MILITARY TYPE TRIGGER

(71) Applicant: George L. Reynolds, Altona, IL (US)

(72) Inventor: George L. Reynolds, Altona, IL (US)

( * ) Notice: Subject to any disclaimer, the term of this patent is extended or adjusted under 35 U.S.C. 154(b) by 0 days.

(21) Appl. No.: 14/319,234

(22) Filed: Jun. 30, 2014

(65) Prior Publication Data

US 2015/0253094 A1 Sep. 10, 2015

Related U.S. Application Data

(60) Provisional application No. 61/947,675, filed on Mar. 4, 2014.

(51) Int. Cl.
*F41A 19/16* (2006.01)
*F41A 19/10* (2006.01)
*F41A 19/12* (2006.01)

(52) U.S. Cl.
CPC ..... *F41A 19/10* (2013.01); *F41A 19/12* (2013.01)

(58) Field of Classification Search
CPC ..... F41A 19/16; F41A 19/21; F41A 19/12; F41A 19/31; F41A 19/56
USPC ..... 42/69.01–70.01
See application file for complete search history.

(56) References Cited

U.S. PATENT DOCUMENTS 2,514,981 A * 7/1950 Walker ..... F41A 17/32 42/69.02
3,718,998 A 3/1973 Hartog
3,798,817 A 3/1974 Zanoni
3,808,724 A 5/1974 Linde
4,004,364 A * 1/1977 Chatigny ..... F41A 19/32 42/69.02
4,026,056 A 5/1977 Roman
4,141,165 A * 2/1979 Dichter ..... F41C 3/14 42/59
4,301,609 A * 11/1981 Peterson ..... F41A 19/31 42/69.02
4,399,628 A 8/1983 Franchi et al.
4,671,005 A * 6/1987 Jewell ..... F41A 17/46 42/69.02
4,866,869 A 9/1989 Mainland
4,908,970 A * 3/1990 Bell ..... F41A 19/12 42/69.01
4,937,964 A * 7/1990 Crandall ..... F41A 19/16 42/69.03
5,012,604 A * 5/1991 Rogers ..... F41A 19/16 42/69.03
5,115,588 A 5/1992 Bronsart et al.
5,487,233 A 1/1996 Jewell
5,718,074 A * 2/1998 Keeney ..... F41A 19/45 42/69.01
5,784,818 A 7/1998 Otteson
5,809,682 A 9/1998 Richert
5,857,280 A * 1/1999 Jewell ..... F41A 19/45 42/69.03
5,881,485 A 3/1999 Milazzo
5,924,231 A 7/1999 Kidd
6,131,324 A 10/2000 Jewell
6,412,206 B1 * 7/2002 Strayer ..... F41A 19/12 42/69.03
6,553,706 B1 4/2003 Gancarz et al.
6,615,527 B1 9/2003 Martin
6,681,511 B1 * 1/2004 Huber ..... F41A 19/16 42/69.01
6,718,680 B2 * 4/2004 Roca ..... F41A 9/45 42/14
6,957,508 B2 10/2005 Sato
7,188,561 B1 3/2007 Kelbly
8,250,799 B2 8/2012 Duperry et al.
8,359,778 B2 1/2013 Doll et al.
2002/0053155 A1 5/2002 Johansson
2004/0237371 A1 12/2004 Orr
2005/0011505 A1 1/2005 Nygaard et al.

(Continued)

*Primary Examiner* — Michael David
(74) *Attorney, Agent, or Firm* — Taft Stettinius & Hollister LLP

(57) ABSTRACT

There is disclosed a two-stage trigger with a large trigger/sear bearing area and an optimized sear loading angle that provides a lightweight trigger-pull. There is further disclosed a safety that blocks rotation of the trigger.

23 Claims, 15 Drawing Sheets

(56) References Cited

U.S. PATENT DOCUMENTS

| | | | | |
|---|---|---|---|---|
| 2005/0188580 | A1 | 9/2005 | Jewell | |
| 2006/0048427 | A1* | 3/2006 | Crandall | F41A 19/09 42/69.01 |
| 2006/0123685 | A1 | 6/2006 | Zeh | |
| 2006/0144379 | A1* | 7/2006 | Wang | B25C 1/043 124/3 |
| 2006/0248772 | A1 | 11/2006 | Curry | |
| 2007/0079539 | A1 | 4/2007 | Karagias | |
| 2007/0246515 | A1 | 10/2007 | Cordes et al. | |
| 2008/0263926 | A1 | 10/2008 | Bubits | |
| 2015/0253094 | A1* | 9/2015 | Reynolds | F41A 19/12 42/69.01 |

* cited by examiner

TWO-STAGE MILITARY TYPE TRIGGER

CROSS-REFERENCE TO RELATED APPLICATION

The present application claims the benefit of the filing date of Provisional Application Ser. No. 61/947,675 filed on Mar. 4, 2014, which is incorporated herein by reference in its entirety.

BACKGROUND

Firearms are equipped with triggers whereby the firearm may be discharged by the shooter. Trigger mechanisms are designed according to the firearm type and the purpose for which the firearm is intended. The trigger mechanism and its associated safing mechanism must not be prone to accidentally permitting or causing the firearm to discharge until the shooter deliberately pulls the trigger. Each type of firearm has unique trigger and safing requirements. This specification generally pertains to rifles; and particularly to bolt action high-power rifles, which shall be referred to as "rifle(s)" hereinafter, but application of the present specification to other firearms is not precluded.

There exists at least one prior art commercially available two-stage trigger that does not function as a typical military two-stage trigger. However, prior art "two-stage trigger" hereinafter refers to the typical military two-stage triggers such as employed in the M1903 Springfield and the M98 Mauser type rifles.

The word "safety" is used in several connotations in this specification. Hereinafter, "mechanical safety" refers to the structural and/or physical characteristics of the mechanical components being discussed. "Safety selector" refers to the safety lever or switch the shooter manipulates in order to set the rifle between "safe" and "fire." Other connotations such as, " . . . safety of bystanders . . . " can be determined from the context.

The ideal rifle trigger mechanism possesses the following characteristics: 1) prevents the rifle from being accidentally discharged, as a result of rough handling, such as from dropping the rifle; irrespective of the safety selector setting; 2) prevents the rifle from accidentally firing as a result of slamming the bolt closed when vigorously manipulating the bolt; 3) consistently provides a crisp, clean "let-off" at exactly the same trigger-pull weight and displacement; 4) is adjustable for both trigger-pull weight and for the elimination of trigger "creep"; and 5) automatically and immediately resets back to its fully seared position after a partial pull and release of the trigger.

The ideal safety (including the mechanism that prevents firing, as well as the safety selector that interfaces with the shooter) possesses the following characteristics (when the safety selector is set to the "safe" position): 1) infallibly prevents the rifle from firing if the trigger is accidentally pulled (or bumped); 2) infallibly prevents the rifle from firing as a result of rough handling, such as dropping the rifle; 3) immediately informs the shooter at a glance and/or by "feel" (including blocking trigger movement) that the safety selector is on "safe"; 4) possesses ergonomic characteristics that permit the shooter to conveniently move the safety selector from "safe" to "fire" with minimal disturbance to aim and with minimal motion of the shooter; 5) is silent as the selector is moved from "safe" to "fire"; and 6) detents into its safe and fire positions without allowing any intermediate positions.

Rifle triggers fall into three general categories: 1) single-stage triggers; 2) two-stage triggers; and 3) set triggers. Set triggers are a specialized form of trigger, which are not discussed in this specification. Safeties for rifle triggers fall into two broad categories: 1) safeties that block the firing pin/striker; and 2) safeties that block the trigger or some intermediate part(s) between the trigger and the firing-pin/striker/hammer.

Since the late $19^{th}$ century two-stage triggers have been employed in most military bolt action rifles. Military two-stage triggers are reliable, safe, easily mass produced, and foster sufficient accuracy so that a reasonably well trained soldier can hit an enemy soldier at moderate combat ranges. However, mass produced military two-stage triggers are not conducive to precision accuracy. In firing a rifle equipped with a two-stage trigger, the first stage of the trigger-pull consists of taking up a substantial amount of slack against friction and spring resistance. At the end of the slack portion of the trigger-pull, the second stage is contacted. The second stage provides significantly more resistance to the trigger, so that by increasing pressure on the trigger, the rifle is fired with real, but ideally indiscernible, further movement of the trigger.

Military two-stage triggers excellently meet the first and primary requirement for a rifle trigger, which is to prevent the rifle from being accidentally discharged as a result of rough handling, such as from dropping the rifle. Prior art two-stage triggers also fully meet the second major requirement which is to prevent the rifle from accidentally firing as a result of slamming the bolt closed when vigorously manipulating the bolt.

A major problem with conventional military two-stage triggers relative to precision marksmanship, however, is that conventional two-stage triggers are susceptible to "creep" at let-off. Trigger creep is the discernible movement of the trigger during the second stage of trigger-pull while moving toward let-off. While second-stage trigger creep before let-off has long been accepted as a fact of life in military rifles, trigger creep is anathema to precision riflemen. This creep could be gunsmithed out of the triggers, but this would not be practical on a mass produced scale, and the modified components would no longer be interchangeable, which would be unacceptable to the military. Another problem relating to mass produced prior art two-stage military rifle triggers relates to trigger-pull weight. The lower trigger-pull weight limit is governed by the force of the striker spring pressing the cocking-piece against the sear. The trigger spring must be strong enough to infallibly reset the trigger and sear to the relaxed position against the force/friction of the cocking-piece if the trigger is partially pulled but then released if the shooter decides not to fire. In other words, the trigger-pull weight can never be less than the trigger return spring force.

Prior art two-stage trigger design and function problems are further exacerbated by the necessarily relatively loose fit of the rifle bolt with the receiver. Military rifle receivers and bolts are designed with a substantial amount of clearance between each other in order to accommodate sand and dirt that inevitably contaminates rifles in typical combat environments. In addition to this designed clearance, the parts are also manufactured to dimensional tolerances which can further increase the clearance. This means that the position of the rear of the bolt can vertically occupy a range of positions from shot to shot.

This is important, as the position of the bolt/cocking-piece within the receiver directly affects the amount of engagement that the sear and cocking-piece will have. This is because, unlike most single-stage triggers which are "modular" or self-contained units (i.e. the components responsible for sear engagement are affixed into the same assembly), most two-stage trigger firing mechanisms are separated into two parts. The first part consisting of the trigger and sear is attached to the bottom of the receiver, while the second part consisting of the cocking-piece is a part of the bolt. Because the bolt with the cocking-piece is free to "float" inside the receiver, the amount of cocking-piece engagement with the sear, which is attached to the receiver, is variable.

Because it is unacceptable to allow a rifle which has a two-stage trigger to fire before the second-stage of the trigger pull is reached, the total sear/cocking-piece engagement must be sufficient (excessive) to cover all possible bolt/cocking-piece positions. Consequently, trigger creep will always occur when the rear of the bolt is positioned low in the receiver because under this condition the sear must be pulled down a significant distance in order to drop below the cocking-piece to fire the rifle. Military rifles used for sniping or for target shooting often have their two-stage triggers "gunsmithed" (altered) to eliminate creep. This practice is common and very effective in meeting the requirement for a crisp, clean let-off at the same trigger-pull weight from shot to shot. However, unless the work is performed by a skilled gunsmith, rifles so altered are more prone to malfunction (e.g. fire during the first stage, or suffer "doubles" in semiautomatic rifles) than unaltered triggers. Furthermore, gunsmithed trigger components are no longer safely interchangeable. Many rifle triggers have been rendered unsafe or ruined by poor gunsmithing.

Historically the solution to trigger creep in mass produced commercial bolt action rifles has been to employ modular single-stage triggers which interpose a sear prop or secondary sear between the trigger and the cocking-piece in the bolt. While single-stage triggers provide the solution to the trigger creep problem of military type two-stage triggers, single-stage triggers introduce their own problems. In single-stage triggers the contact between the trigger and the sear provides only an extremely fine engagement (0.005 to 0.015 thousandths of an inch). When the safety is "off," this small engagement is all that prevents accidental discharge when the rifle is loaded and cocked. This potentially dangerous condition inherently exists when slamming the bolt closed, or jolting or dropping the rifle, which can jar the rifle/trigger sufficiently to fire the rifle. This flaw has resulted in a number of deaths of bystanders, as well as much litigation against well-known rifle manufacturers who produce otherwise excellent rifles.

Another shortcoming of single-stage triggers is that the shooter "feels" the entire weight of the trigger-pull at let-off. However, with a two-stage trigger, the shooter only "feels" the additional (cumulative) weight of the second stage. That is, while technically (with everything else being equal) a single-stage trigger will sear-off at the same "poundage" as a similarly set two-stage trigger, the two-stage trigger will only "feel like" the weight of the second stage as the shooter has already felt and compensated for the weight of the first stage. While this is mostly a matter of perception (psychological), the actual force needed to overcome the second stage is less when the pressure exerted on the first stage is viewed as a "preload."

The safety selector of most single-stage triggers function by blocking the sear from moving. Other safety selectors block the movement of the trigger or cocking-piece, etc. In the types of trigger assemblies where the sear is blocked, it is absolutely critical that the sear be lifted slightly from the trigger during safing. That is, the safety must cam the sear away slightly from the trigger in order to ensure that the sear cannot drop off of the trigger in the event that the trigger is accidentally pulled or bumped while the safety selector is on "safe." Failing to achieve the needed trigger/sear separation would allow the sear to drop off of and get below/behind the trigger. In this event the trigger would not be able to reset to its cocked position. In other words, the sear and therefore the cocking-piece/striker would be released from the seared (cocked) position with nothing but the safety holding up the sear. This condition is extremely unsafe, as the sear and therefore the cocking-piece/striker would be resting on the safety, poised to fire when the safety selector is switched "off." To put it another way, the sear would become the "trigger," and when the safety selector is switched "off" (back to "fire") the rifle will fire or discharge of its own accord without the trigger being pulled.

It should be pointed out that this type of safety that cams the sear up off of the trigger can wear out with use due to, for example, scraping against the sear. That is to say, despite the safety being properly manufactured and functioning properly initially, the safety can be rendered "unsafe" simply by use, to say nothing of abuse.

Typically the safety selectors of military bolt action rifles, while mechanically very reliable, are inconveniently located on the upper rear of the bolt-group/bolt-sleeve. This location is directly in line with the rifle sights. Consequently, the shooter's view of the sights is blocked when moving the safety selector from "safe" to "fire," thus disturbing his aim. When a telescopic sight is employed on a rifle with this type of safety it is often difficult to reach the safety selector as there can be very little room under the rear of the scope. Also, these types of safeties (on the bolt-sleeve) typically require the shooter to make a relatively large hand movement to set/reset the safety selector, again resulting in the disturbance of aim.

The safety selectors of most single-stage triggers are usually more conveniently located. The knobs of such selectors are usually located at the rear of the actions, either directly behind, or along-side the receivers. In these locations the selector knobs can usually be actuated without requiring the shooter to move more than his thumb so there need be no disturbance to his or her aim. However, these types of safeties typically do not block the movement of the trigger when set to "safe." This is important as there is no tactile indication to the shooter that the safety is set on "safe" while the trigger is pulled attempting to fire. This can result in the shooter missing the opportunity to hit his patiently waited for, and carefully aimed at, target. While it might seem improbable that a shooter would be "unaware" (or forget) that his rifle safety selector is set to "safe," this scenario is far more common than one might expect, especially in high stress, excitement, combat and/or hunting situations. In some bolt action rifles that employ bolt-sleeve safeties, whether provided with two-stage or single-stage triggers, pulling the trigger with the safety on "safe," permits the striker group to snap forward with a noisy "click" into a safety notch in the bolt-sleeve but not firing. The first thought of a shooter under these circumstances may be to wonder if there has been a miss-fire or other malfunction. Typical miss-fire procedure is to wait thirty seconds before opening the bolt to insure that a hang-fire is not occurring. Thirty seconds is (hopefully) long enough to insure a miss-fire isn't really a hang-fire, because unlocking the bolt on a hang-fire can be lethal to the shooter, let alone destroying the rifle. Given that the shooter now realizes that the "click" was not a miss-fire but that the safety is on "safe," then in order to "re-prepare" the rifle to fire, the bolt handle must be raised, requiring time and motion and making more noise, to re-cock the striker, then the bolt must be closed again, yet more time and motion and making yet more noise. Only then can the bolt-sleeve safety be moved to "fire," with yet more time and motion. In a tactical scenario this consumption of several noisy seconds could result in failure of the mission, as well as exposing and endangering the shooter.

The operation of the novel safety selector completely eliminates the time, motion and noise problem described in the above paragraph. Firstly, the novel trigger/safety blocks the movement of the trigger immediately indicating to the shooter that the safety selector is set to "safe." Secondly, because the striker is not allowed to move, the firing mechanism always remains cocked. Lastly, the novel safety selector's knob is conveniently located, requiring only minimal movement to actuate.

Briefly reviewed, the advantage of conventional prior art two-stage triggers is that they excellently meet the primary and secondary requirements for a rifle trigger by preventing the rifle from accidentally discharging. The disadvantages of prior art two-stage triggers are: 1) prior art two-stage military triggers inherently cannot provide lightweight trigger-pulls; 2) mass produced prior art two-stage military triggers cannot safely provide a crisp trigger-pull without being "gunsmithed"; and 3) prior art military two-stage triggers are equipped with inconvenient bolt-sleeve safeties.

The advantages of prior art single-stage triggers are: 1) prior art single-stage triggers can provide crisp, lightweight trigger-pulls; and 2) prior art single-stage triggers are inherently amenable to incorporation of ergonomically convenient safety selectors. The major disadvantage of prior art single-stage triggers is that they invariably provide only a few thousandths of an inch of engagement between the trigger and the sear when the rifle is cocked, and are therefore prone to accidental discharge. One type of single stage trigger attempts to solve the problem of accidental discharge of single-stage triggers by interposing a secondary sear-blocker co-axial with, and nested within the trigger. In order to fire a rifle with the aforementioned single stage trigger, the secondary sear-blocker, which protrudes through the front of the trigger, is depressed by the trigger finger prior to contacting/depressing the actual trigger. Depressing the secondary sear-blocker moves the secondary sear-blocker out of the path of the sear so that as the trigger finger continues to move rearward, the trigger finger contacts and depresses the trigger proper, firing the rifle in the usual manner. The function of the sear-blocker is to arrest the sear in the event the rifle is jarred enough to cause the trigger to release the sear unexpectedly.

This single stage trigger design effectively prevents accidental firing if the rifle is dropped. However, when this single stage trigger performs its safety function, it is necessary to raise and lower the bolt handle to re-cock the rifle before it can be fired. This means that if the rifle is sufficiently jarred so that the sear drops off the trigger, the rifle is not immediately fireable. This is an undesirable condition at best, especially if the shooter is unaware that it has occurred.

SUMMARY

The novel two-stage trigger disclosed herein provides at least one or all of the advantages of prior art two-stage triggers and at least one or all the advantages of prior art single-stage triggers while eliminating at least one or all the disadvantages of prior art two-stage triggers and at least one or all the disadvantages of prior art single-stage triggers. Briefly stated immediately below, and then elaborated upon further below, the advantages of the novel two-stage trigger disclosed herein include at least one of the following: 1) robustly meets the first and primary requirement for a rifle trigger by preventing the rifle from accidentally discharging as a result of rough handling, such as when dropping the rifle; regardless of the safety selector setting; 2) fully meets the second major trigger requirement in that it prevents the rifle from accidentally firing as a result of slamming the bolt closed, as when vigorously manipulating the bolt; regardless of the safety selector setting; 3) provides a crisp, clean trigger-pull; 4) can provide a wide range of trigger-pull weights, including "light" weights; 5) does not require "gunsmithing" to obtain a clean, crisp let-off; 6) automatically and immediately resets back to its fully seared position after a partial pull and release of the trigger; 7) includes only a few simple parts, which are all easily mass produced, and are all fully interchangeable.

The advantages of the novel safety mechanism and safety selector disclosed herein include at least one of the following: 1) robustly and securely prevents movement of the trigger, which in turn, robustly prevents movement of the sear/striker; 2) blocks initial movement of the trigger, the trigger itself signals the shooter when the safety selector is on "safe"; 3) does not require tightly toleranced (expensive, "gunsmithed") parts to function properly; 4) does not require the lifting ("camming" up) of the sear to be safe/reliable; 5) not subject to wear, which could result in the degradation of function over time; 6) conveniently located, requiring no disturbance to the shooter/point-of-aim when switching from "safe" to "fire"; and 7) all parts are easily mass produced, and are fully interchangeable.

The novel two-stage trigger provides a large trigger/sear bearing (contact) area until the first stage is taken up. The large bearing area renders the trigger mechanically very safe. Additionally, in the first embodiment, the sear pivot is located such that only a low force over the broad bearing area is applied between the trigger and the sear. Low sear force against the trigger permits a light and clean trigger-pull to be achieved, as the trigger is permitted to slide easily relative to the sear in spite of the high striker spring force being applied through the cocking-piece/striker. This combination permits a safe, clean trigger-pull and a crisp, no-creep, let-off.

When the novel trigger is fully released (finger off the trigger), such as when cycling the bolt or when handling a loaded and cocked rifle, the engagement area between the trigger and sear is large and deep thus providing the safe-handling feature of conventional two-stage military triggers. The large and deep engagement of the first stage also means that rapid and economical manufacturing processes may be employed, as very fine or small engagement surfaces are not needed.

The fine adjustment of the second stage let-off of the novel trigger is achieved through the simple adjustment of an off-the-shelf spring-plunger that the trigger contacts at the second stage portion of the trigger-pull. The nose of the spring-plunger stops the movement of the trigger at a point just prior to let-off that corresponds to the initial position of a single-stage trigger. Increasing pressure on the trigger depresses the spring-plunger, hence the second stage, which in turn leads to let-off which releases the sear, firing the rifle.

In this specification, the location of the safety selector is shown immediately behind the bolt handle, protruding from a slot in the rifle stock. This location permits the shooter to switch from safe to fire without taking his eye off the sights, and without making conspicuous motions with his hands. However, many other safety selector locations are possible, including directly behind the receiver, inside the trigger guard, or other suitable location. The "safety" incorporated into the inventive two-stage trigger positively blocks rotation of the trigger when the safety selector is set to "safe."

DETAILED DESCRIPTION OF THE ILLUSTRATED EMBODIMENTS

Figure 1:
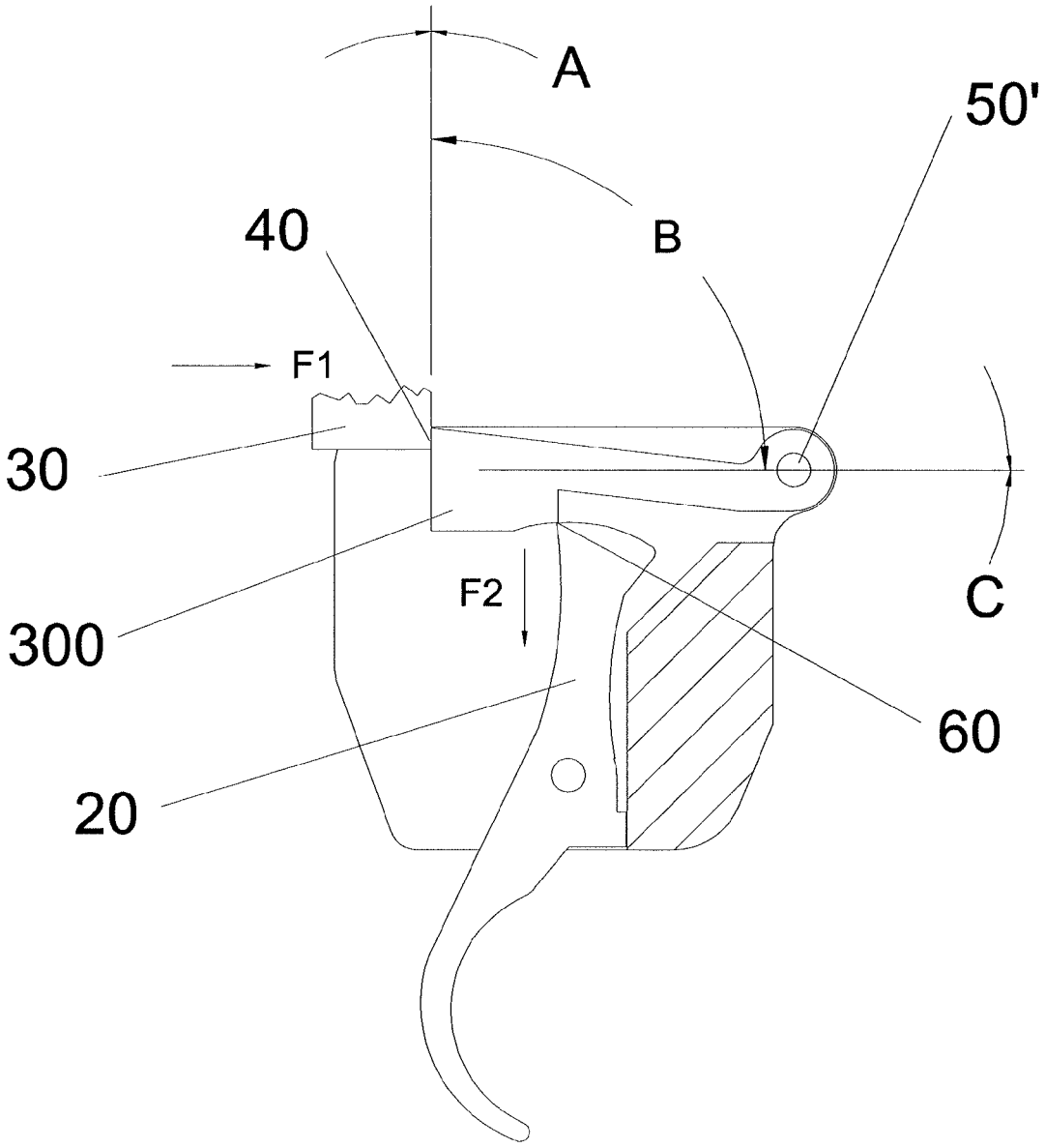
FIG. 1 is a schematic illustrating one form of a "zero-force" trigger/sear.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

The novel trigger is effectively a hybrid of prior art two-stage triggers and single-stage triggers; retaining the desirable characteristics of single-stage and two-stage triggers while eliminating their undesirable characteristics.

For the purposes of the description, friction is acknowledged as a practical design factor, but is ignored (except where noted) in this document as not being required for understanding the principles of the invention. In the description, when the term "released" is used relative to the trigger, it means the shooter's trigger finger is off the trigger.

Definition of "angles" A, B, C and forces F1 and F2 as shown in the drawings are provided. Force F1 represents the spring force supplied to the cocking-piece via the striker spring. This force F1 will, for the purposes of this specification, always be the same; applied from the same location/direction (directly horizontally along the axis of the rifle barrel) and be of the same force.

Force F2 (which is variable) is the amount of force by which the sear is urged downwardly. Force F2 is determined by both the angle at which the sear and cocking-piece interface, and by the relative position of the sear pivot. That is, when angle A is larger than zero, the force F1 of the cocking-piece against the sear will be redirected downwardly at force F2 with a greater (or lesser) force depending upon the "slant" of angle A. Likewise, as angle C increases from zero, the force F1 of the cocking-piece against the sear will be redirected downwardly at force F2 with a greater (or lesser) force.

Angle A is the angle at which the cocking-piece and sear interface, relative to the direction of force F1, the direction of movement of the cocking-piece when firing the firearm. In other words, angle A is the downward deflection angle of force F1 as the cocking-piece "cams" against the sear. When angle A is zero (relative to a line orthogonal to the direction of force F1), none of force F1 is directed downwardly, consequently there would be no force F2. Downward force F2 is increased as angle A increases. The maximum achievable downward force is reached as angle A approaches 180°. Only angles less than 180° will produce downward force, as angle A at 180° would be parallel (no "camming action") to force F1. Angles greater than 180° would exert an "upward" force upon the sear, if that were possible.

Angle B is the angle between the cocking-piece/sear interface, and the sear pivot. Angle B is always dependent upon the cocking-piece/sear interface angle A. That is, angle B originates from angle A, and varies according to the location of the sear pivot. Varying angle B effects force F2. Angles of less than 90° will result in a downward force F2 being exerted on the trigger/sear. An angle of 90° will result in no force F2 being exerted, and angles of greater than 90° would result in a negative force (−F2) being exerted on the sear.

Angle C is the difference between angle B and 90°. That is, angle C and angle B will always add up to 90°. Angle C is shown to illustrate the "amount" (magnitude) to which angle B effects force F2. Referring now to FIG. 1 which is a schematic illustrating a zero-force trigger/sear where angle B at cocking-piece/sear interface 40 is arranged 90° relative to sear pivot 50 so that the full force F1, of the striker spring (not shown) on cocking-piece 30, is delivered at zero degrees angle A directly to sear pivot 50, with zero down force F2 borne by trigger 20 at trigger/sear engagement 60 regardless of the magnitude of force F1. In fact, even if trigger 20 were pulled (or even removed), cocking-piece 30 would remain cocked. Obviously this arrangement would not be suitable as a practical trigger mechanism but is illustrated to help in understanding the present invention.

Figure 2:
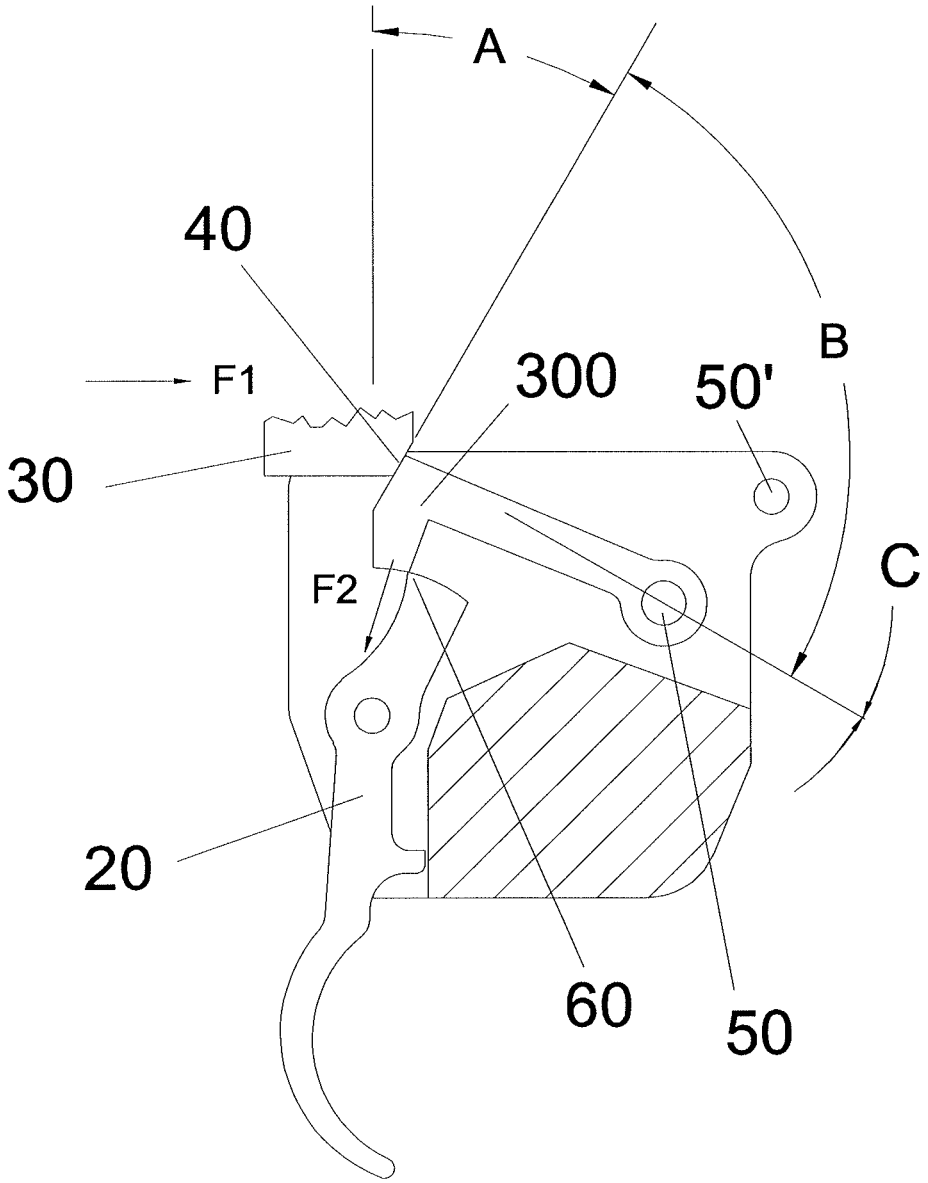
FIG. 2 is a schematic illustrating another "zero-force" trigger sear.

Referring now to FIG. 2 where cocking-piece 30 and sear 300 are shown with a 30° angle A as is found in many commercial rifles. Sear pivot 50 is (as in FIG. 1) shown with angle B disposed 90° relative to cocking-piece/sear interface 40 which (as in FIG. 1) makes angle C zero degrees, meaning downward force F2 against trigger 20 is still zero (as in FIG. 1) regardless of the magnitude of force F1. In this case, as in FIG. 1, pulling trigger 20 will not result in release of cocking-piece 30; therefore the rifle would not fire. Again as in FIG. 1, trigger 20 could be removed, but cocking-piece 30 would remain cocked. Obviously (as in FIG. 1) this arrangement would not be suitable as a practical trigger mechanism, but is shown to illustrate the fact that as angle "B" approaches 90°, downward force F2 diminishes and becomes zero.

Figure 3:
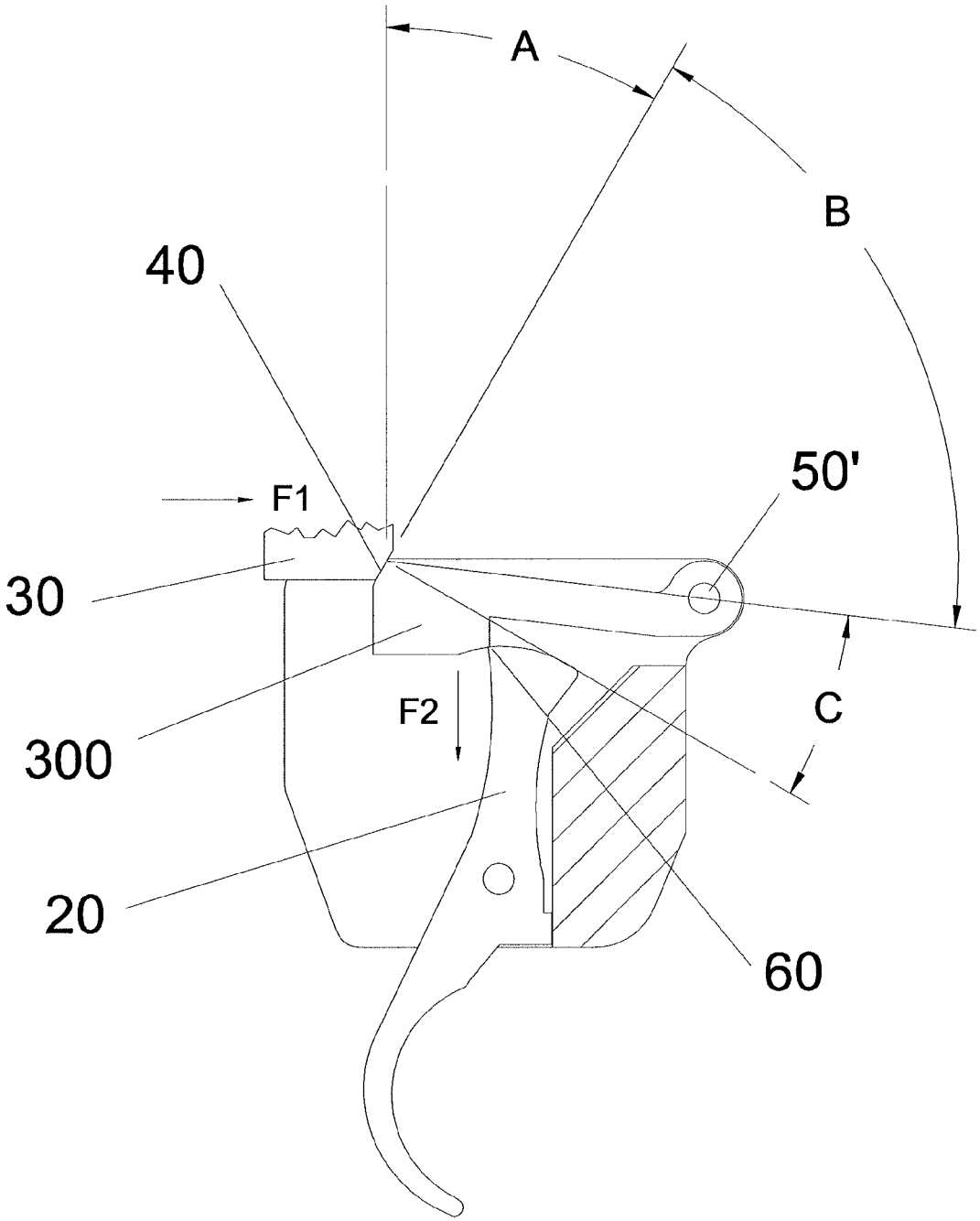
Fig. 3 (Prior Art)
FIG. 3 is a schematic illustrating the operating principle of a typical prior art single-stage commercial trigger.

Referring now to FIG. 3 which is a schematic representing a caricature of several popular single-stage triggers in use with many name-brand rifles. These triggers typically employ a cocking-piece and sear having a 30° angle A at cocking-piece/sear interface 40, and a sear pivot 50' that is the same pin that holds the trigger assembly to the receiver. In some triggers with the arrangement shown in this figure, angle C is about 23°. Given that angle A remains constant, then increasing angle B, which coincidentally decreases angle C, reduces force F2 at trigger/sear engagement 60.

Figure 4:
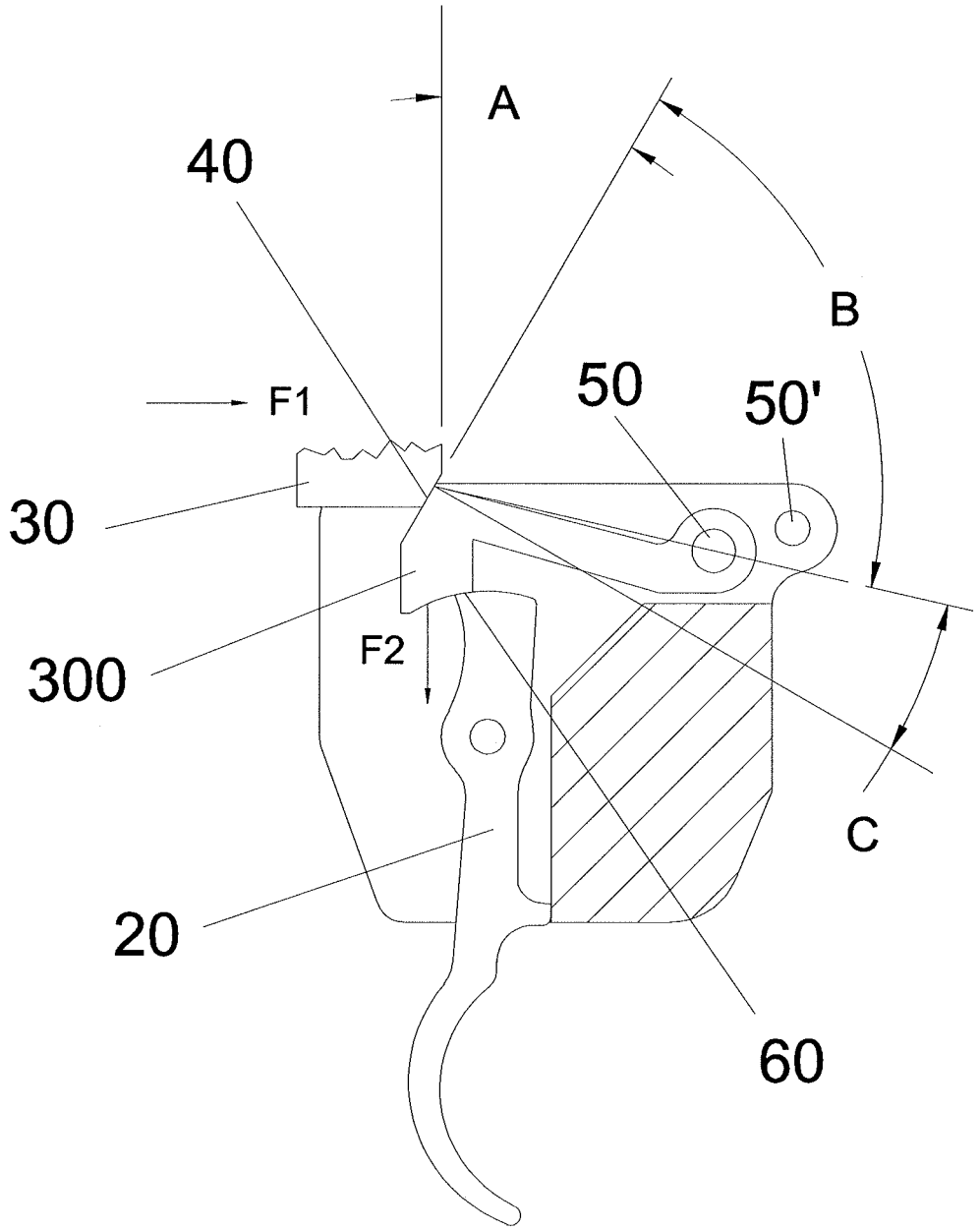
FIG. 4 is a schematic illustrating a reduced force trigger/sear as can be employed in any of the embodiments of the two-stage trigger.

Referring now to FIG. 4 which is a schematic illustrating a practical reduced force F2 sear, as could be employed in any of the embodiments of the novel two-stage trigger, or employed with a number of conventional single-stage triggers. In FIG. 4 the sear pivot 50 is added to the trigger assembly at a location that is spaced downwardly (relative to the direction of force F1) from the location of the pivot 50' used to mount the trigger assembly to the receiver, which increases angle B. Downward force F2 is reduced from that shown in FIG. 3 by an amount governed by angle C since the smaller angle C becomes, the less force F2 will become, resulting in a lower force F2 at trigger/sear engagement 60. Reducing the force applied at trigger/sear engagement 60 increases the functional life of the working ledges at trigger/sear engagement 60, and enhances trigger-pull "smoothness." In one embodiment, angle C is less than 23°. In another embodiment, angle C is less than 20°. Having a reduced force F2 also permits a lower force trigger return spring and lower force trigger-pull to be employed while maintaining the functional reliability/safety of the trigger mechanism. That is, as less force (and therefore less friction) is applied to trigger/sear engagement area 60, less force is required to ensure that the friction of this contact area will be overcome in the event that the trigger is released and returned to its fully-forward/un-pulled position after having been partially pulled just short of the point of firing.

Figure 5:
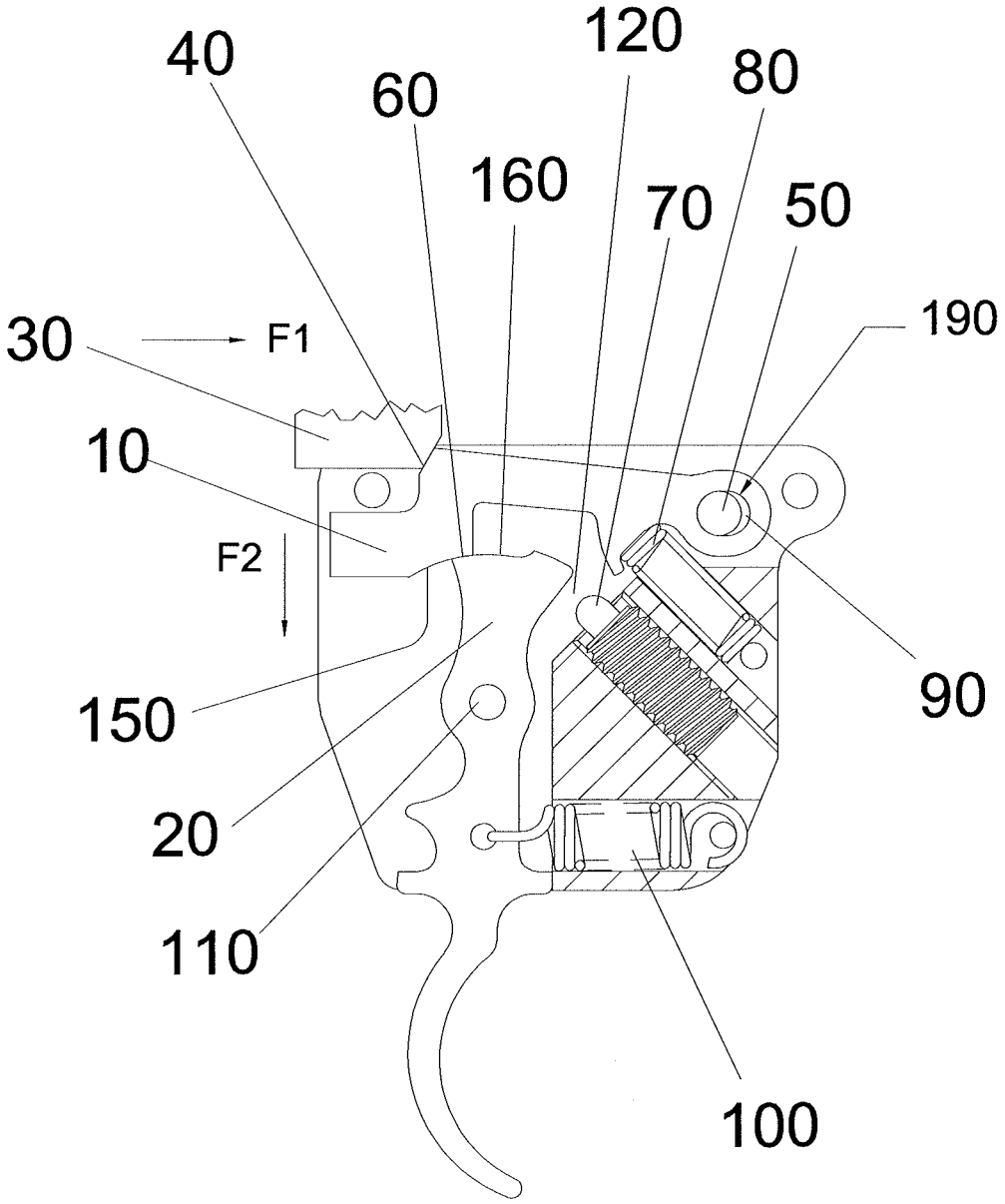
FIG. 5 illustrates the first embodiment two-stage trigger with the trigger in the cocked position, that is, before the first stage of the trigger-pull is taken up.

Referring now to FIG. 5 which illustrates the first embodiment of the novel trigger. Cocking-piece 30 bears against reciprocating sear 10 at cocking-piece/sear interface 40 with a force F1 applied by a striker spring (not shown). In actual rifles, force F1 typically ranges from 15-30 lbs. Trigger 20 engages reciprocating sear 10 at trigger/sear engagement 60 defining a first bearing area, with reciprocating sear 10 acting to retain cocking-piece 30 in the cocked position. Trigger 20 is rotatable about trigger pivot pin 110.

Figure 6:
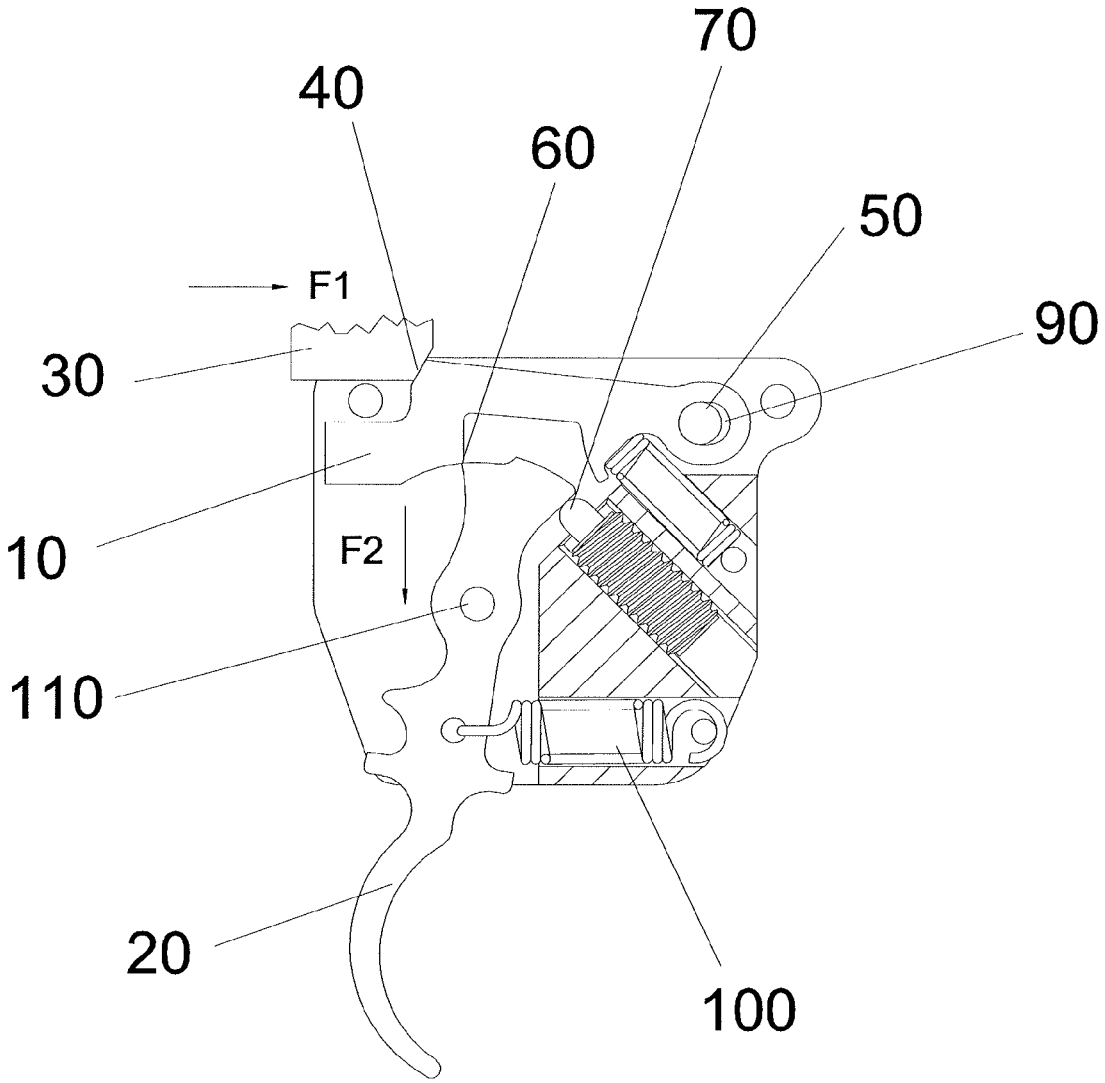
FIG. 6 illustrates the first embodiment two-stage trigger with the first stage of the trigger-pull taken up, but the trigger stopped in contact with the spring-plunger.
Figure 7:
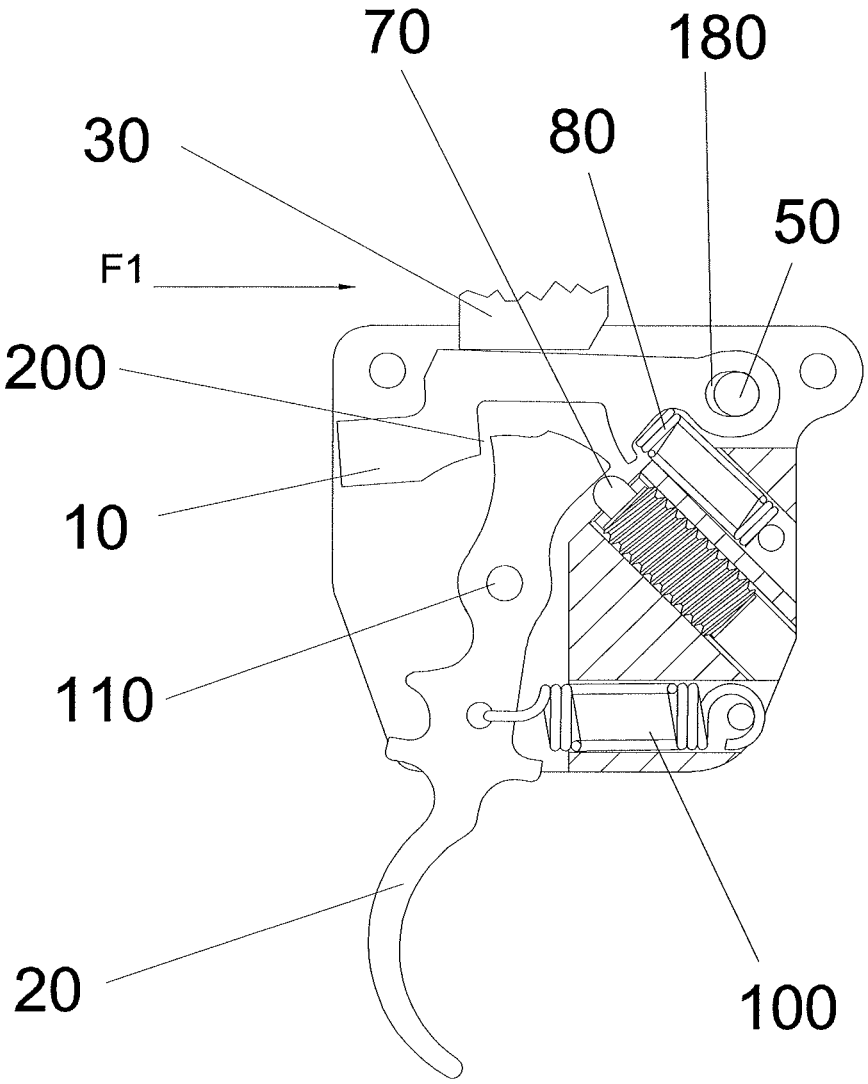
FIG. 7 illustrates the first embodiment two-stage trigger with the second stage of the trigger-pull having been pulled sufficiently to fire the rifle.
Figure 8:
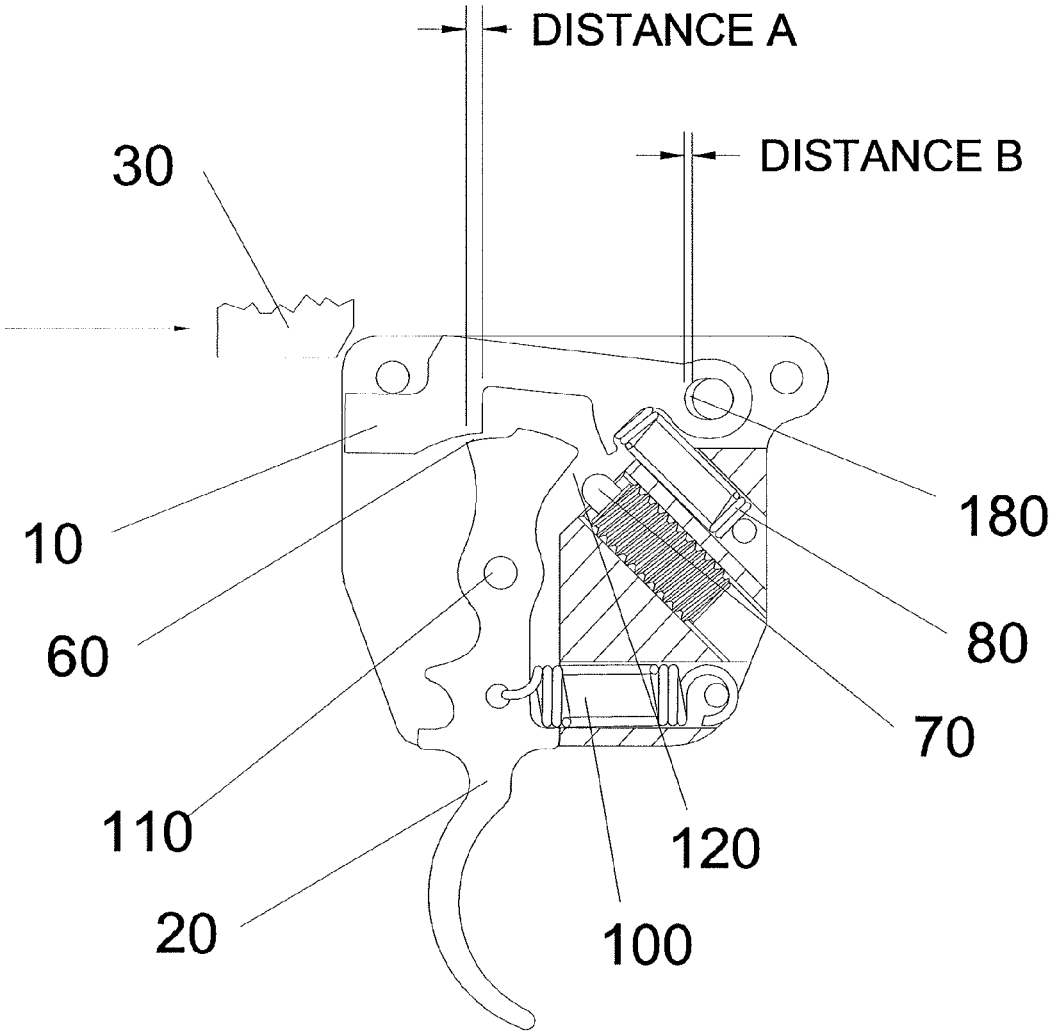
FIG. 8 illustrates the invention two-stage trigger "at rest," without the influence of the striker/cocking-piece.

Reciprocating sear 10 is described as "reciprocating" because it reciprocates between the position shown in FIGS. 5 and 6, as compared to its position shown in FIGS. 7 and 8. Reciprocating sear 10 provides two functions, to be enumerated.

For the purposes of this specification the center of the radius of trigger arc 160 is shown as being coincident and concentric with the axis of trigger pin 110, and sear arc 150 is shown as having the same radius, and is concentric with trigger arc 160 when sear 10 is in its current/forward position with trigger arc 160. While this arrangement would result in the (theoretically) most precise alignment of the parts, which is advantageous from the standpoint of friction and surface engagement, it is not essential for function, and should therefore not be considered limiting.

Continuing with FIG. 5, since trigger arc 160 and sear arc 150 are equal and concentric, they will be in intimate contact with each other all through the first stage of the trigger-pull. In this figure, it can be seen that the length of the contact area of trigger/sear engagement 60 is several times deeper than a conventional single-stage trigger. Consequently, the novel trigger is essentially immune from accidental discharge due to rough handling of the rifle, as the novel trigger has essentially the same sear/cocking-piece/trigger engagement area of typical military two-stage triggers.

Typically single-stage triggers are factory set with about 0.005 to 0.015 inch length of engagement between the trigger and the sear. This means that only a ledge of about 0.005 to 0.015 inch of engagement prevents (hopefully) the rifle from firing if the rifle is dropped.

In the novel trigger the generous length, which can be ten times, or more, than that of a conventional single-stage trigger, of contact of trigger/sear engagement 60 insures that the rifle cannot accidentally fire as the result of shock loads resulting from rough handling, such as dropping. Furthermore, since trigger/sear engagement 60 intimately bears on an arc, the sharp, finely honed final contact edges of trigger/sear engagement 60 are not subjected to abuse resulting from rough handling of the rifle.

One feature of the trigger assembly is that trigger 20 is rotatable (slideable) relative to sear 10 during the first or "slack" stage of the trigger-pull. This is unlike prior art triggers.

In prior art ("military") two-stage triggers, the sear (not the trigger) is slideable relative to the cocking-piece during the first/slack stage of the trigger-pull. That is, in a prior art two-stage trigger, when the trigger is pulled, the sear is "dragged" out of engagement with the cocking-piece rather than the trigger sliding out from under the sear, as in the novel trigger.

Still referring to FIG. 5, there is a first stage gap 120 between the top of trigger 20 and the end of spring-plunger 70. The width of first stage gap 120 determines the length of the first stage of the trigger-pull. That is, the first stage of the trigger-pull will occur in the distance defined by first stage gap 120. The first stage gap 120 is the distance that trigger 20 swings between its released (un-pulled) position until the top of trigger 20 contacts spring-plunger 70 at the start of the second stage. The trigger-pull force of the first stage is primarily determined by the spring force of trigger spring 100. The friction of trigger 20 with sear 10 at trigger/sear engagement area 60 also contributes to the trigger-pull weight, in both the first and second stages.

Additionally, spring-plunger 70 also determines the length and weight of the second stage of the trigger-pull. The location of spring-plunger 70, which is adjustable, dictates the location at which the second stage of the trigger-pull begins (which is where the first stage ended) and thereby controls the amount of engagement and therefore the amount of creep that trigger 20 and sear 10 will have at let-off. If spring-plunger 70 is screwed toward trigger 20 the first stage rotation will be arrested sooner, thereby increasing the second stage trigger/sear engagement, consequently increasing the amount of creep that the second stage will have. The converse is also true, screwing spring-plunger 70 away from trigger 20 will allow trigger 20 to rotate farther before being arrested by spring-plunger 70, thereby decreasing the second stage trigger/sear engagement, consequently decreasing the amount of creep that the second stage will have. In addition, in certain embodiments, the weight of the second stage of the trigger-pull can be arranged so that a negligible difference from the weight of the pull in the first stage of the trigger-pull is recognized by the shooter (essentially eliminating the second stage from the perception of the shooter), or the second stage can be entirely eliminated. Screwing spring-plunger 70 away from trigger 20 far enough, or removing spring-plunger 70 from the trigger assembly, will allow trigger 20 to rotate uninhibitedly from the first stage of the trigger pull through let-off, thereby completely eliminating the second stage. Such arrangements may be advantageous for a novice shooter or others that do not want to anticipate let-off, possibly improving aim while diminishing the potential for flinching.

The spring force of spring-plunger 70 determines the weight of the second stage of the trigger-pull. The greater the spring force of spring-plunger 70, the harder trigger 20 must be pulled in order depress spring-plunger 70, and thereby release sear 10 to fire the rifle. Trigger-pull force (weight) is cumulative. That is, the force of spring-plunger 70 is added to the spring force of trigger spring 100 during the second stage of the trigger-pull.

Continuing with FIG. 5, slot 190 in reciprocating sear 10, permits reciprocating sear 10 to move forward, as shown in FIGS. 5 and 6 under the influence of cocking-piece 30 with its striker spring (not shown). Front gap 90 is created in front of and between sear pivot 50 and reciprocating sear 10 when reciprocating sear 10 is in the current forward position. Pressure from the striker spring against cocking-piece 30 and consequently against reciprocating sear 10, overcomes and compresses sear spring 80, which causes reciprocating sear 10 to be pressed against sear pivot 50, thus securely retaining reciprocating sear 10 in this position relative to the released trigger 20. In this condition, trigger arc 160 and sear arc 150 are coincident and concentric with each other, maintaining a full and uniform bearing surface at trigger/sear engagement 60.

With reciprocating sear 10 in this position, trigger/sear engagement area 60 is many times larger than the corresponding bearing area of any prior art single-stage trigger. The large trigger/sear engagement area 60 of the novel trigger provides the very desirable, inherent mechanical safety of the trigger assembly. Trigger spring 100 restrains trigger 20 in the position shown.

Dropping the cocked rifle will impart momentum to the whole rifle, including the trigger assembly. The center of gravity of trigger 20, as shown, is somewhat below trigger pivot 110, meaning that if dropped the lower portion of trigger 20 would have more momentum than the upper part of trigger 20. If the rifle were dropped butt down, the greater momentum of the lower portion of trigger 20 would tend to rotate the lower portion of trigger 20 toward the firing position. While this tendency is undesirable, testing has shown that, even with a trigger as asymmetrical as the one shown in these Figures, trigger spring 100 is sufficiently strong to arrest and return trigger 20 to its original position (at all normal trigger-pull weights), preventing accidental firing due to dropping or other severe mishandling. It would further be possible to design the trigger so its center of gravity is exactly coincident (see FIG. 13) with the axis of trigger pin 110, thereby obviating the momentum issue.

Referring now to FIG. 6. In normal marksmanship practice, the first stage of a two-stage trigger is taken up as the rifle is initially being aimed at the target. In this figure, trigger 20 has been pulled sufficiently against the resistance of trigger spring 100 to rotate trigger 20 around trigger pivot 110 so that trigger/sear engagement 60 has become very small, defining a second bearing area less than the first bearing area. This small engagement is equivalent to the full trigger/sear engagement in conventional high quality single-stage triggers. In other words, taking up the first stage slack of the novel trigger effectively causes the trigger assembly to function as a superior quality single-stage trigger from that point on as far as the shooter is concerned or feels.

Should the shooter decide not to continue to pull trigger 20 from the point just before let-off shown in FIG. 6, trigger spring 100 would be required to rotate trigger 20 back to its released position as shown in FIG. 5. That is, trigger spring 100 must be sufficiently strong to rotate trigger 20 back to its released (un-pulled) position over the resistance of the friction at trigger/sear engagement area 60 in the event that the shooter decides not to fire the rifle after having already taken up the first stage of the trigger-pull.

The friction at trigger/sear engagement area 60, which can be reduced by a number of means, dictates the lower limit of the trigger-pull weight that the novel trigger can achieve. In other words, because the strength ("weight") of trigger spring 100 must be strong or heavy enough to overcome the friction at trigger/sear engagement area 60 to reposition trigger 20, and because the weight of the first stage of the trigger-pull can never be lower than the spring force of trigger spring 100, the weight of the first stage of the trigger-pull can never be less than the force needed to overcome the friction at trigger/sear engagement area 60.

In the event that trigger spring 100 fails to overcome the friction at trigger/sear engagement area 60 as described in the scenario above, and therefore fails to return trigger 20 to its proper released position, the novel trigger would still be "as safe" as a conventional single-stage trigger. That is, the novel trigger in the position shown in FIG. 6 would still have the same trigger/sear engagement area as a conventional single-stage trigger, and would therefore be no more prone to accidental firing. Continuing with FIG. 6, the top front of trigger 20 has been rotated into contact with the end of spring-plunger 70. In other words, trigger 20 has been rotated to the point that first stage gap 120 of FIG. 5 has been eliminated. The added resistance of spring-plunger 70 prevents trigger 20 from being pulled farther without the shooter increasing finger pressure on trigger 20. At this point the bearing area of the two-stage trigger has been reduced to, and behaves exactly as, a high quality single-stage trigger, except that because of the location of sear pivot 50 force F2 is reduced compared to that of conventional single-stage triggers. This reduced load at trigger/sear engagement 60 means that the sharp working edges of trigger/sear engagement 60 can be made finer and sharper, while providing a longer working life than conventional single-stage triggers.

Referring now to FIG. 7, as trigger 20 is pulled farther from the position shown in FIG. 6 by pivoting trigger 20 about trigger pivot 110, trigger spring 100 extends slightly, and the compression of the nose of spring-plunger 70 begins. The movement of trigger 20 diminishes and then eliminates the engagement of trigger 20 with reciprocating sear 10 at what was previously trigger/sear engagement 60. When trigger 20 and reciprocating sear 10 are thus disengaged, the rear of reciprocating sear 10 is no longer supported by trigger 20, therefore reciprocating sear 10 is urged downwardly by cocking-piece 30. With reciprocating sear 10 no longer blocking cocking-piece 30, cocking-piece 30 is free to be driven forward by force F1 of the striker spring, firing the rifle.

With the striker spring being much stronger than sear spring 80, sear spring 80 was held compressed via reciprocating sear 10 as in FIGS. 5 and 6. Now, in FIG. 7 with cocking-piece 30 and reciprocating sear 10 released from each other, sear spring 80 can now urge reciprocating sear 10 rearward. Sear spring 80 also biases the rear of reciprocating sear 10 upward against the bottom of cocking-piece 30 preparatory to repositioning reciprocating sear 10 at re-cocking.

The reason for permitting reciprocating sear 10 to be displaced rearwardly by sear spring 80 is to generate trigger/sear gap 200 between trigger 20 and reciprocating sear 10. The reason for trigger/sear gap 200 is to prevent trigger 20 from being pinched between spring-plunger 70 and reciprocating sear 10 after firing. That is, if the top of trigger 20 were pinched (lodged) between spring-plunger 70 and the rear/inside edge of reciprocating sear 10, then sear spring 80 would not be able to return reciprocating sear 10 to its original (upward) position. Consequently, trigger 20 could not return to its original position, and reciprocating sear 10 and therefore neither the cocking-piece nor the striker would be retained (cocked) when the bolt was cycled.

Referring now to FIG. 8. When the bolt (not shown) is vigorously cycled (i.e. the bolt is slammed forward), it is essential that the rear of reciprocating sear 10 not be driven ("cammed") down by cocking-piece 30 behind trigger 20 before reciprocating sear 10 is carried forward to the cocked position. That is, the downward movement of reciprocating sear 10 must be arrested by the top of trigger 20 despite the position of reciprocating sear 10 being farther to the rear than when in the cocked position.

In FIG. 8 it can be seen that reciprocating sear 10 has been urged rearwardly a distance represented as Distance "B." As long as Distance "B," which is the length of rear gap 180 and/or front gap 90, and therefore the distance that sear 10 reciprocates, is shorter than Distance "A," which is the length of trigger/sear engagement 60, sear 10 cannot reciprocate rearward far enough to drop behind the top of trigger 20 with the trigger released. This is simply a design consideration. That is, the distance to which sear 10 reciprocates and the amount to which trigger 20 engages sear 10 at the sear's rearward most position must be taken into account as the trigger/sear is designed. However, this principle is not essential to the understanding of the trigger's function.

Figure 9:
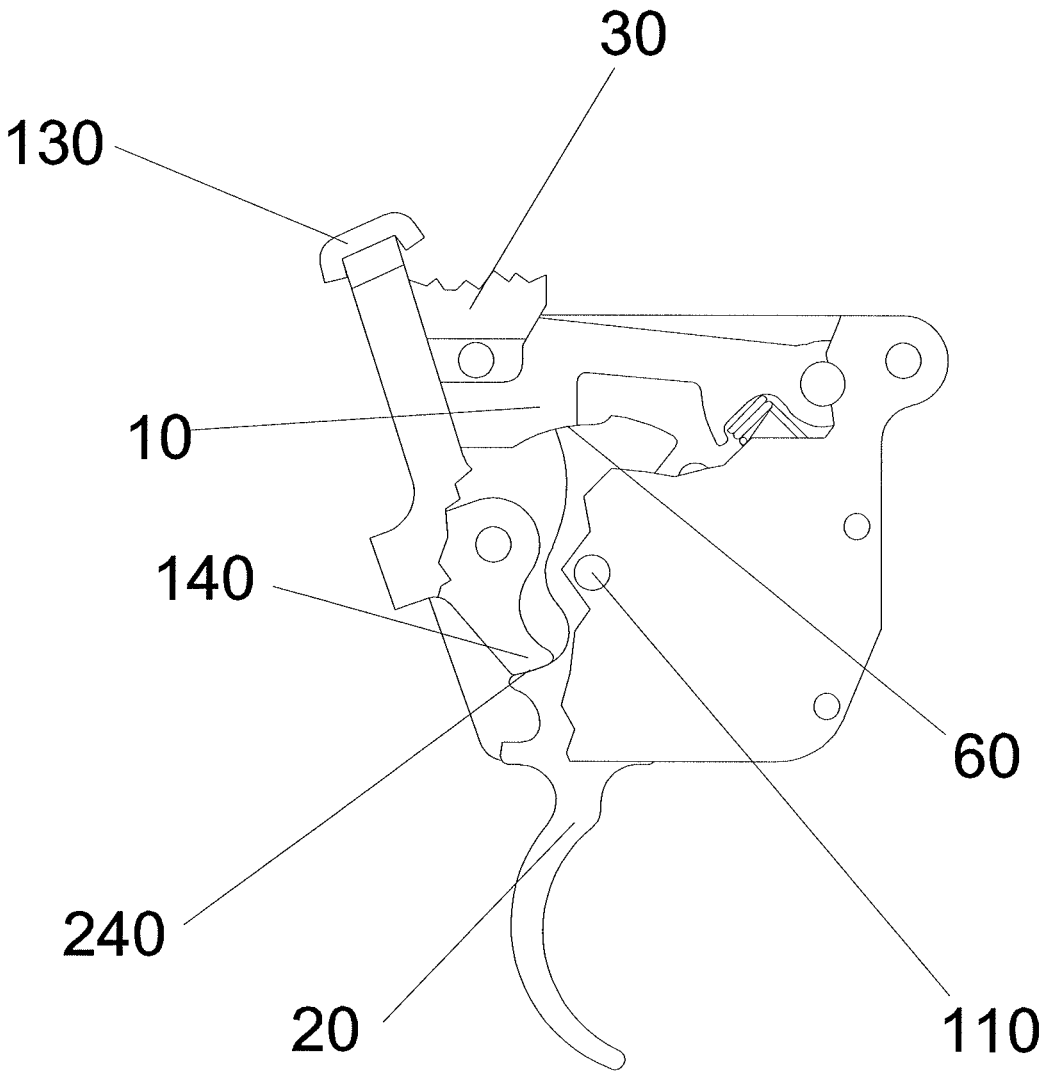
FIG. 9 illustrates the safety selector in the "safe" position.

Referring now to FIG. 9, safety selector 130 has been rotated counterclockwise so that safety shoe 140 has been rotated into position positively blocking trigger 20 at safety/trigger engagement area 240. In this condition, safety shoe 140 of safety selector 130 positively blocks trigger 20 at safety/trigger engagement area 240, while the top of trigger 20 is in substantial engagement with reciprocating sear 10 at trigger/sear engagement 60 preventing reciprocating sear 10 from moving, while reciprocating sear 10, in turn, blocks cocking-piece 30 from moving forward. The depths and areas of trigger/sear engagement 60 and safety/trigger engagement area 240 are so robust that under no reasonable operational circumstances can the rifle be accidentally fired with the safety on.

Further, if the shooter begins to apply pressure to trigger 20 while safety selector 130 is on safe, trigger 20 will be prevented from executing its first stage of pull by contact at safety/trigger engagement area 240, thereby immediately informing the shooter that safety selector 130 is set on "safe." This is a valuable characteristic that a single-stage trigger cannot provide.

Figure 10:
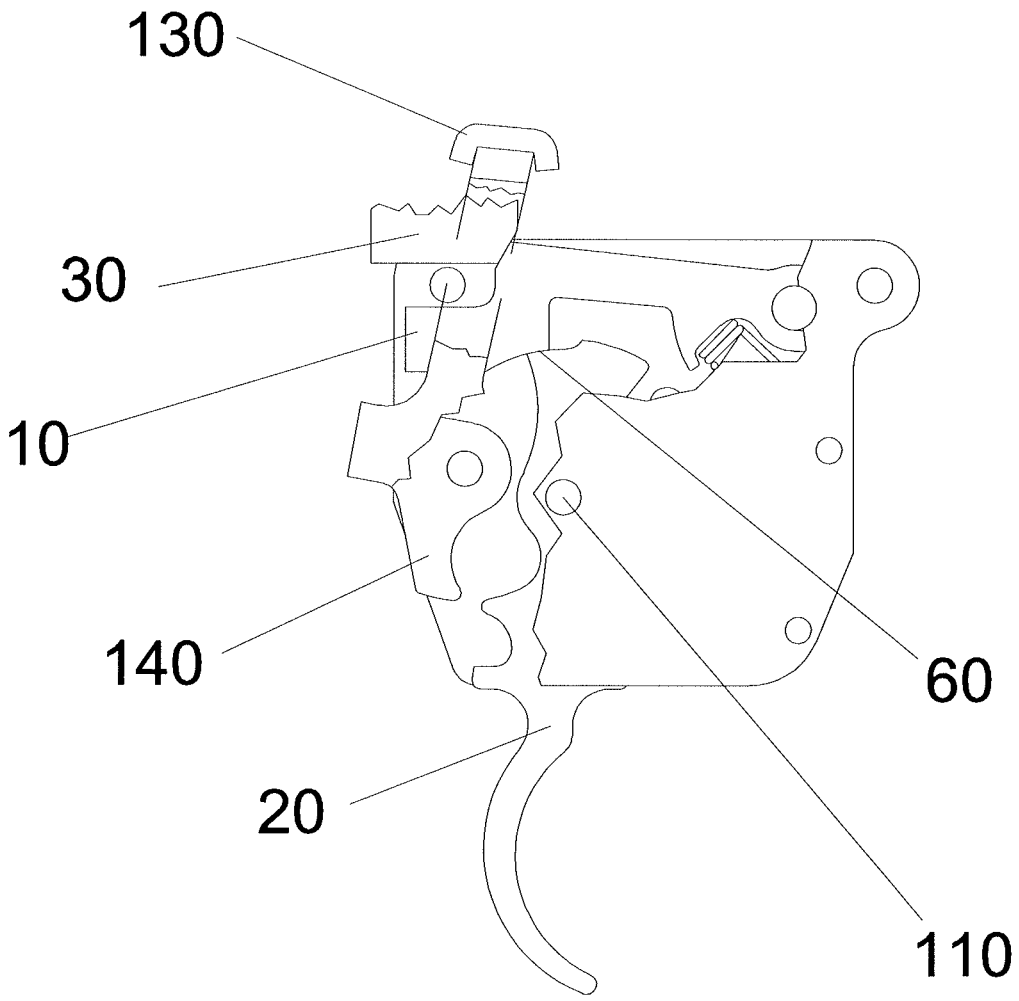
FIG. 10 illustrates the safety selector in the "fire" position.
Figure 11:
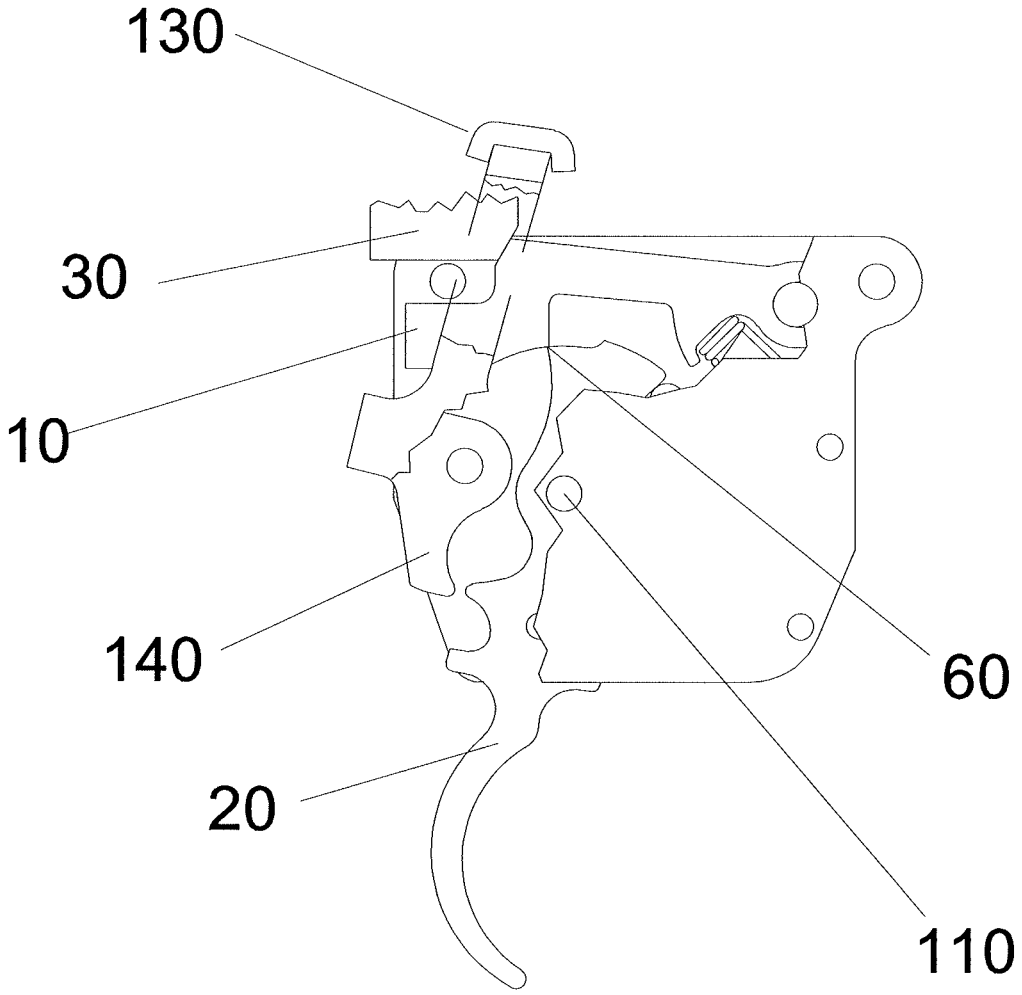
FIG. 11 illustrates the safety selector in the "fire" position, and the trigger at the second stage.

Referring now to FIG. 10, in which safety selector 130 has been rotated clockwise out of the way of trigger 20, so the rifle can be fired by pulling trigger 20. Referring now to FIG. 11, which illustrates safety selector 130 in the "fire" position, and trigger 20 pulled to the second stage. This Figure shows that, while in the "fire" (rotated clockwise) position, safety shoe 140 does not block the movement of trigger 20.

Figure 12:
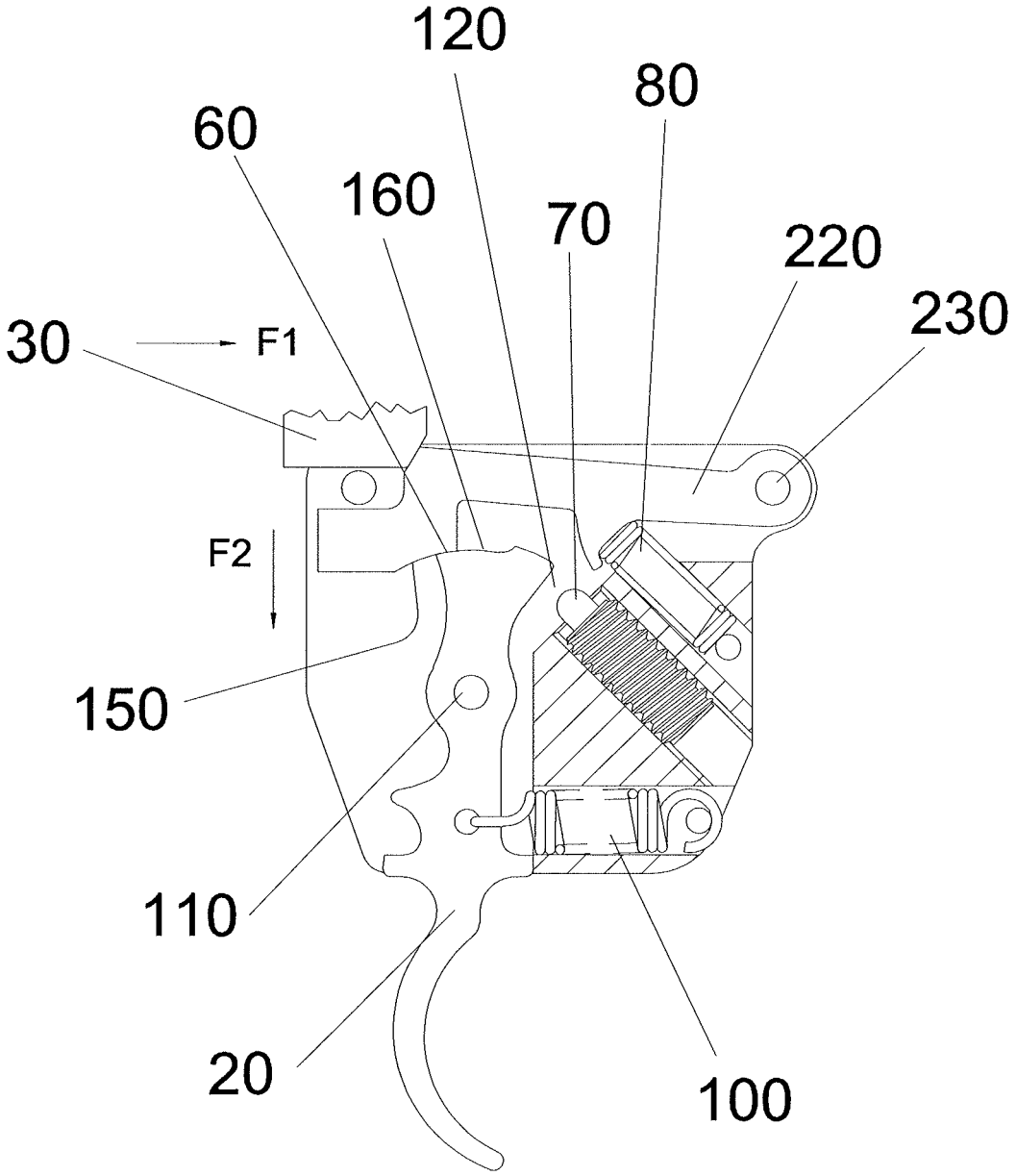
FIG. 12 illustrates a second simplified embodiment of the two-state trigger without a reciprocating sear.

FIG. 12 illustrates a second simplified embodiment in which slot 190 (of previous Figures) has been replaced with a simple hole, and reciprocating sear 10 has been replaced with non-reciprocating sear 220. In this embodiment the non-reciprocating sear 220 no longer reciprocates, which is common practice in prior art single-stage triggers. This embodiment requires that sear spring 80 be designed with sufficient force as is common practice in prior art single-stage triggers to overcome the pinching of trigger 20 between non-reciprocating sear 220 and spring-plunger 70. In this embodiment non-reciprocating sear 220 pivots about sear pivot/front mounting pin 230, however a reduced force F2 type sear arrangement as described in FIG. 4 could be employed. The rest of this second embodiment functions the same way as the first embodiment.

Figure 13:
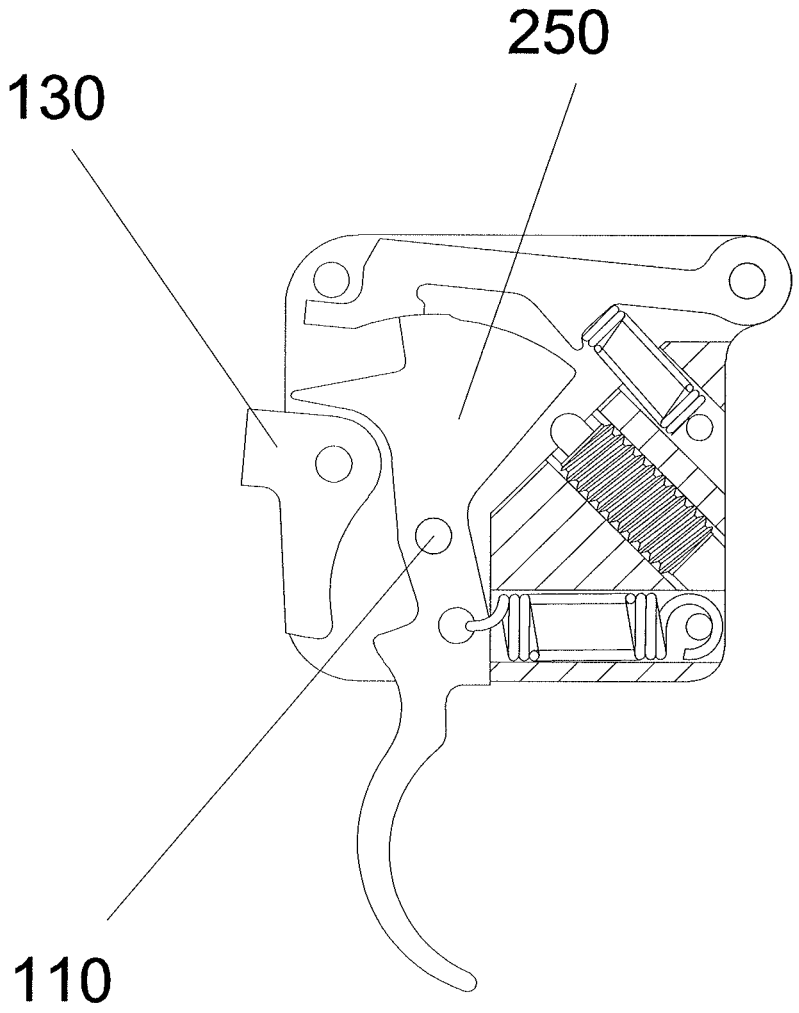
FIG. 13 illustrates a balanced trigger.

FIG. 13 illustrates balanced trigger 250, in which the center of gravity of balanced trigger 250 is coincident with trigger pivot pin 110. That is, balanced trigger 250 has as much mass above pivot pin 110 as below pivot pin 110. The purpose of this figure is to demonstrate that a perfectly balanced trigger can be designed, which is completely immune from accidental firing as a result of dropping or other rough handling, even with the safety "off."

Figure 14:
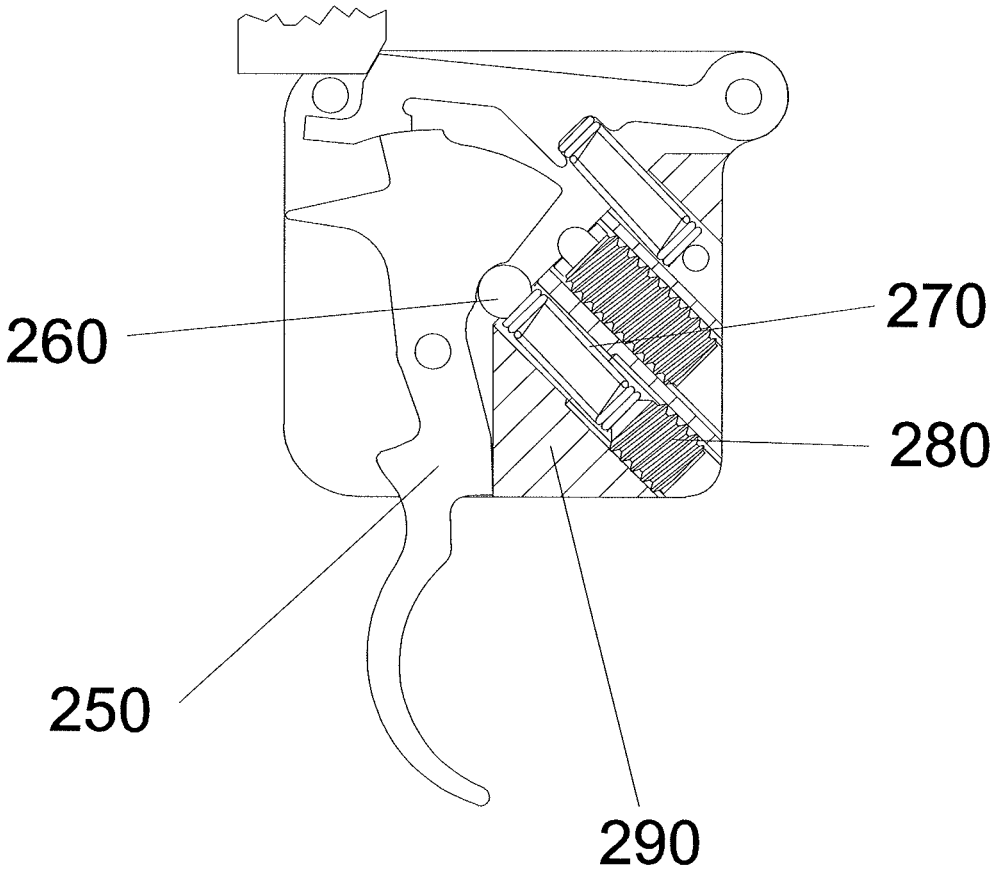
FIG. 14 illustrates a third embodiment of the two-stage trigger provided with an adjustable first stage trigger force spring/screw, shown with the trigger released.

FIG. 14 illustrates a third embodiment wherein the weight of the first stage of the trigger pull is adjustable. In this Figure, trigger 250 is shown in the fully released position. Trigger spring adjusting screw 280 threadedly engages with trigger body 290, such that screwing adjusting screw 280 inwardly or outwardly changes the preload on trigger compression spring 270, thereby increasing or decreasing the preload pressure on trigger 250 via ball bearing 260. The change in preload pressure against trigger 250 translates into a change of force needed to take up the first stage of the trigger pull, therefore the first stage of the trigger pull is adjustable.

Ball bearing 260 slideably fits within its hole so it can move freely. Ball bearing 260 is not necessary to allow the trigger mechanism to "function." That is, trigger compression spring 270 would function without ball bearing 260, but ball bearing 260 is included to improve the "feel" (smoothness) of the trigger pull. Ball bearing 260 not only provides a smooth surface upon which trigger 250 can uniformly slide/roll as opposed to the uneven end of trigger compression spring 270, ball bearing 260 also serves to hold trigger compression spring 270, via an appropriately located "timing" notch in trigger 250, centered in its spring pocket. Trigger compression spring 270 is also held (centered) in its spring pocket by the cone shaped end of trigger spring adjusting screw 280, thereby eliminating any friction/roughness that might be felt if trigger compression spring 270 were allowed to contact (rub) the spring pocket walls during the trigger pull.

Figure 15:
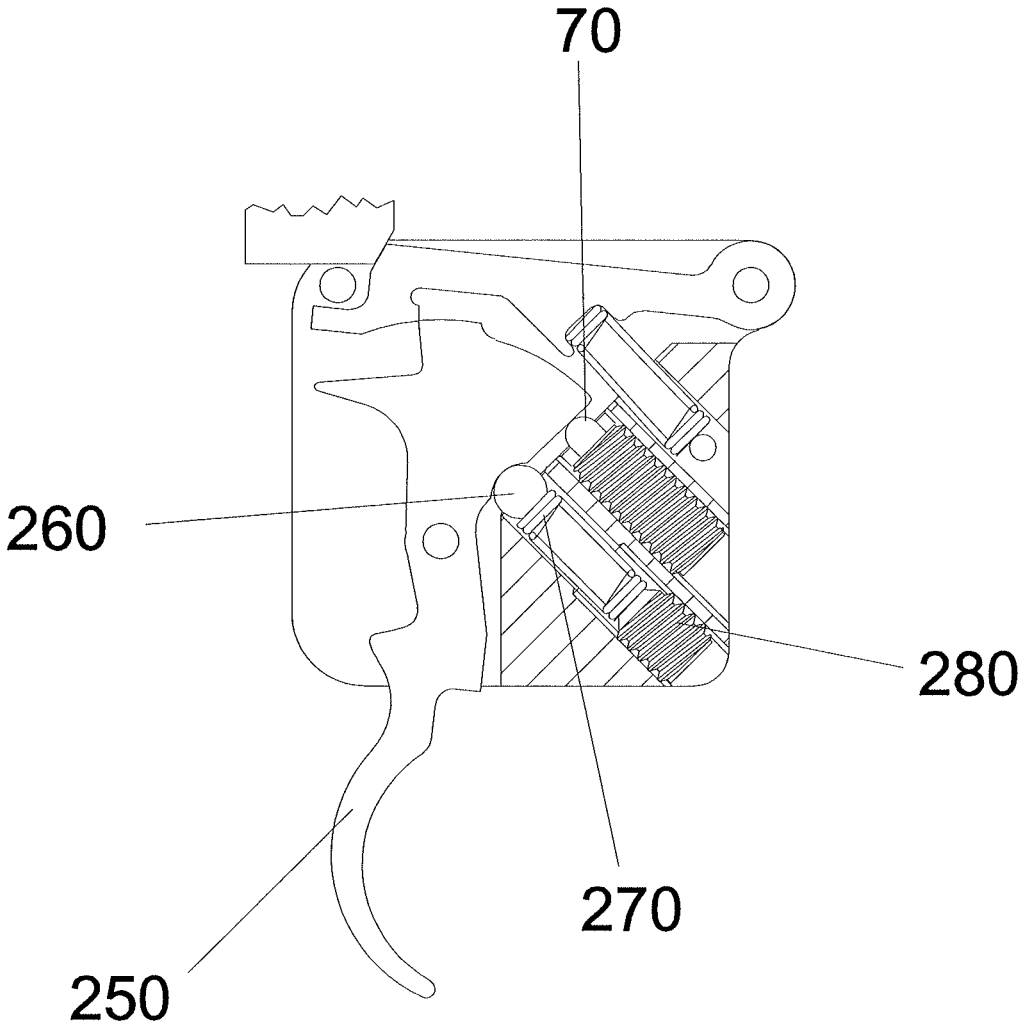
FIG. 15 illustrates the third embodiment at the end of the first stage of trigger pull.

FIG. 15 is like FIG. 14 except trigger 250 has been sufficiently pulled to take up all of the first stage of the trigger pull, with trigger 250 in contact with spring plunger 70. As in the previous embodiments, the resistance supplied by spring plunger 70 is additive to the resistance provided by trigger compression spring 270. This means that if the first stage of the trigger pull is two pounds, and the resistance of spring plunger 70 is two pounds, then the total trigger pull force necessary to fire the rifle will be four pounds. Or, if adjusting screw 280 is screwed inwardly sufficiently to yield a first stage trigger pull of four pounds, then six pounds of trigger pressure will be required to fire the rifle. In other words, regardless of the setting/adjustment of adjusting screw 280, and therefore the poundage of the first stage of the trigger pull, the resistance (poundage) of second stage spring plunger 70 will always be additive to the resistance provided by the first stage of the trigger pull.

Various aspects of the disclosed embodiments are contemplated. For example, according to one aspect, a trigger assembly for a firearm includes a sear biased against or into the path of and engageable with a cocking-piece at a cocking-piece/sear interface to maintain the cocking-piece in a cocked position. The sear is pivotable about a sear pivot to selectively release the cocking-piece from the cocked position. The assembly also includes a trigger mounted to a trigger body. The trigger is pivotable about a trigger pivot in a first stage of movement from a first position to a second position. In the first position the trigger engages the sear at a trigger/sear engagement that defines a first length of engagement of the sear on the trigger and in the second position the trigger contacts a spring member while engaged with the sear at the trigger/sear engagement to define a second length of engagement of the sear on the trigger that is less than the first length of engagement. The trigger is further movable in a second stage of movement from the second position against the spring member to disengage the trigger from the sear and allow the sear to pivot about the sear pivot to disengage the sear from the cocking-piece and release the cocking-piece.

According to one embodiment, the sear is non-reciprocating relative to the sear pivot. In another embodiment, the sear reciprocates relative to the sear pivot when the sear is disengaged from the trigger. In a refinement of this embodiment, the sear includes a slot at the sear pivot and the sear is reciprocable relative to the sear pivot along the slot. In a further refinement, the slot defines a first gap with the sear pivot at a first side of the slot when the sear is engaged to the cocking-piece and the slot defines a second gap with the sear pivot at a second side of the slot when the sear is disengaged with the cocking-piece. In yet a further refinement, a sear spring is connected to the sear to bias the sear toward the cocking-piece in the cocked position.

According to another embodiment, the trigger defines a trigger arc and the sear defines a sear arc, and the trigger/sear engagement is created by frictional engagement between the trigger and the sear along the trigger arc and the sear arc. In one refinement of this embodiment, the trigger arc and the sear arc slide on one another during the first stage of movement. In another refinement, the first bearing area is defined by contact between the trigger and the sear along the trigger arc and the sear arc.

In another embodiment, the trigger assembly includes a sear spring urging the sear upward and rearward against or into the path of the cocking-piece/sear interface when the cocking-piece is in the cocked position. In yet another embodiment, the spring member is a spring plunger that is adjustable to adjust a trigger pull distance for the second stage of movement. In a further embodiment, the trigger assembly includes a trigger spring biasing the trigger into engagement with the sear at the trigger/sear engagement during the first stage of movement. In a refinement of this embodiment, an adjusting screw is engaged to the trigger body and the trigger spring is adjustable with the adjusting screw to increase or decrease a trigger pull weight of the trigger during the first stage of movement. In a further refinement, the trigger spring is engaged to the trigger with a ball bearing and the trigger slides around the ball bearing during the first stage of movement and the second stage of movement. In yet a further refinement, the adjusting screw and the ball bearing are configured to center the trigger spring in a spring pocket of the trigger body.

In another embodiment, the trigger assembly includes a safety selector including a knob and a safety shoe opposite or spaced from the knob. The safety selector is rotatable relative to the trigger from a fire position permitting pivoting of the trigger to a safe position where the safety shoe positively engages the trigger while the trigger is in the first position in engagement with the sear, the safe position thereby preventing the sear from disengaging from the cocking-piece. In yet another embodiment, the trigger moves relative to the sear during the first stage of movement and the sear remains fixed relative to the cocking-piece during the first stage of movement.

According to another aspect, a trigger assembly for a firearm includes a sear engageable with a cocking-piece at a cocking-piece/sear interface to maintain the cocking-piece in a cocked position. The sear is pivotable about a sear pivot to selectively disengage the sear from the cocking-piece. The trigger assembly further includes a sear spring urging the sear against or into the path of the cocking-piece/sear interface and a trigger mounted to a trigger body. The trigger is pivotable about a trigger pivot in response to a first pull weight for a first stage of movement during which the trigger engages the sear at a trigger/sear engagement so that the sear maintains the cocking-piece in the cocked position. The trigger is further pivotable about the trigger pivot in response to a second pull weight for a second stage of movement to disengage the trigger from the sear which allows the sear to pivot about the sear pivot and disengage from the cocking-piece to release the cocking-piece. The trigger moves relative to the sear during the first stage of movement and the sear remains fixed relative to the cocking-piece during the first stage of movement.

In one embodiment, the first stage of movement ends when the trigger contacts a spring member while engaged with the sear at the trigger/sear engagement with a second bearing area that is less than the first bearing area. In a refinement of this embodiment, the trigger is movable during the second stage of movement to compress the spring member to disengage the trigger from the sear. In another embodiment, the second pull weight is greater than the first pull weight. In another embodiment, the second pull weight is eliminated or negligible relative to the first pull weight.

According to another aspect, a trigger assembly for a firearm includes a two-stage trigger pivotably mounted to a trigger body. The trigger is pivotable about a trigger pivot in a first stage of movement from a first position to a second position while the trigger is engaged with a sear that is engaged to a cocking-piece in a cocked position. The trigger is further pivotable in a second stage of movement requiring a greater pull weight than the first stage of movement. The second stage of movement begins from the second position and continues to disengage the trigger from the sear which disengages the sear from the cocking-piece. A pull weight of the first stage of movement is adjustable by manipulating a trigger spring that adjustably biases the trigger relative to the trigger body.

According to one embodiment, the trigger body defines a spring pocket for retaining the trigger spring, and trigger assembly includes an adjustment screw engaged to the trigger body that is configured to adjust the pull weight. In a refinement of this embodiment, the trigger spring is engaged to the trigger with a ball bearing. In a further refinement, the adjusting screw and the ball bearing are configured to center the trigger spring in a spring pocket of the trigger body.

According to another aspect, a safety and trigger assembly for a firearm includes a two-stage trigger pivotably mounted to a trigger body. The trigger is pivotable about a trigger pivot in a first stage of movement to move the trigger relative to a sear while the trigger is engaged with the sear. The sear is engaged to a cocking-piece in a cocked position and the sear remains stationary relative to the cocking-piece during the first stage of movement. The trigger is further pivotable in a second stage of movement from an end of the first stage of movement, the second stage of movement requiring a greater pull weight than the first stage of movement. In the second stage of movement the trigger is disengaged from the sear to disengage the sear from the cocking-piece. The trigger assembly further includes a safety selector including a knob and a safety shoe spaced from the knob. The safety selector is rotatable relative to the trigger from a fire position to a safe position, the fire position permitting pivoting of the trigger about the trigger pivot during the first stage of movement, and in the safe position the safety shoe positively engages the trigger to prevent the trigger from moving to execute the first stage of movement, thereby preventing the sear from disengaging from the cocking-piece.

According to another aspect, a firearm assembly includes a cocking-piece biased for movement in a first direction during firing of the firearm. The firearm assembly also includes a trigger assembly including a sear and a trigger and the trigger assembly is mounted to the firearm at a first pin location. The sear is engageable with the cocking-piece at a cocking-piece/sear interface to maintain the cocking-piece in a cocked position, and the sear is further pivotable about a sear pivot to selectively disengage the sear from the cocking-piece. Relative to the first direction, the sear pivot is spaced downwardly from the first pin location. The trigger is mounted to a trigger body and pivotable about a trigger pivot while the trigger engages the sear at a trigger/sear engagement so that the sear maintains the cocking-piece in the cocked position. The trigger is further pivotable about the trigger pivot to disengage the trigger from the sear, which allows the sear to pivot about the sear pivot and disengage from the cocking-piece to release the cocking-piece from the cocked position.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

LIST OF ELEMENTS

10 reciprocating sear
20 trigger
30 cocking-piece
40 cocking-piece/sear interface
50 novel sear pivot
50' prior art sear pivot
60 trigger/sear engagement
70 spring-plunger
80 sear spring
90 front gap
100 trigger spring
110 trigger pivot pin
120 first stage gap
130 safety selector
140 safety shoe
150 sear arc
160 trigger arc
180 rear gap
190 slot
200 trigger/sear gap
220 non-reciprocating sear
230 sear pivot/front mounting pin
240 safety/trigger engagement area
250 balanced trigger
260 ball bearing
270 trigger compression spring
280 trigger spring adjusting screw
290 trigger body
300 sear

What is claimed is:

1. A trigger assembly for a firearm, comprising:

a sear biased into a path of and engageable with a cocking-piece of the firearm at a cocking-piece/sear interface to maintain the cocking-piece in a cocked position, the sear being pivotable about a sear pivot to selectively release the cocking-piece from the cocked position;

a trigger extending from a trigger body and rotatable about a trigger pin;

a trigger spring connecting the trigger and the trigger body; and a spring plunger mounted to the trigger body, wherein the trigger is pivotable about a trigger pivot in a first stage of movement from a first position to a second position with the trigger spring biasing the trigger into engagement with the sear at a trigger/sear engagement during the first stage of movement, wherein in the first position the trigger engages the sear at the trigger/sear engagement that defines a first length of engagement of the sear on the trigger and a first stage gap is defined between the trigger and the spring plunger so the trigger is not in contact with the spring plunger, and further wherein in the second position the trigger contacts the spring plunger while engaged with the sear at the trigger/sear engagement to define a second length of engagement of the sear on the trigger that is less than the first length of engagement, wherein the trigger is further movable in a second stage of movement from the second position against the spring plunger and the trigger spring to disengage the trigger from the sear and allow the sear to pivot about the sear pivot to disengage the sear from the cocking-piece and release the cocking-piece.

2. The trigger assembly of claim 1, wherein the sear is non-reciprocating relative to the sear pivot.

3. The trigger assembly of claim 1, wherein the sear reciprocates relative to the sear pivot when disengaged from the trigger.

4. The trigger assembly of claim 3, wherein the sear includes a slot at the sear pivot and the sear is reciprocable relative to the sear pivot along the slot.

5. The trigger assembly of claim 4, wherein the slot defines a first gap with the sear pivot at a first side of the slot when the sear is engaged to the cocking-piece and the slot defines a second gap with the sear pivot at a second side of the slot when the sear is disengaged with the cocking-piece.

6. The trigger assembly of claim 5, further comprising a sear spring connected to the sear to bias the sear toward the cocking-piece when in the cocked position.

7. The trigger assembly of claim 1, wherein a top end of the trigger defines a trigger arc and the sear defines a sear arc, and the trigger/sear engagement is created by frictional engagement between the trigger and the sear along the trigger arc and the sear arc.

8. The trigger assembly of claim 7, wherein the trigger arc and the sear arc slide on one another during the first stage of movement.

9. The trigger assembly of claim 7, wherein the first bearing area is defined by contact between the trigger and the sear along the trigger arc and the sear arc.

10. The trigger assembly of claim 1, further comprising a sear spring urging the sear upward into the path of the cocking-piece/sear interface when the cocking-piece is in the cocked position.

11. The trigger assembly of claim 1, wherein the spring plunger is adjustable to adjust a trigger pull distance for the second stage of movement.

12. The trigger assembly of claim 1, further comprising a trigger spring biasing the trigger into engagement with the sear at the trigger/sear engagement during the first stage of movement.

13. The trigger assembly of claim 12, further comprising an adjusting screw engaged to the trigger body, wherein the trigger spring is adjustable with the adjusting screw to increase or decrease a trigger pull weight of the trigger during the first stage of movement.

14. The trigger assembly of claim 13, wherein the trigger spring is engaged to the trigger with a ball bearing and the trigger slides against the ball bearing during the first stage of movement and the second stage of movement.

15. The trigger assembly of claim 14, wherein the adjusting screw and the ball bearing are configured to center the trigger spring in a spring pocket of the trigger body.

16. The trigger assembly of claim 1, further comprising a safety selector including a knob and a safety shoe spaced from the knob, wherein the safety selector is rotatable relative to the trigger from a fire position permitting pivoting of the trigger to a safe position where the safety shoe positively engages the trigger while the trigger is in the first position in engagement with the sear, the safe position thereby preventing the sear from disengaging from the cocking-piece.

17. The trigger assembly of claim 1, wherein the trigger moves relative to the sear during the first stage of movement and the sear remains fixed relative to the cocking-piece during the first stage of movement.

18. A trigger assembly for a firearm, comprising:

a sear biased into a path of and engageable with a cocking-piece of the firearm at a cocking-piece/sear interface to maintain the cocking-piece in a cocked position, the sear being pivotable about a sear pivot to selectively release the cocking-piece from the cocked position;

a trigger extending from a trigger body, the trigger being pivotable about a trigger pivot in a first stage of movement from a first position to a second position, wherein in the first position the trigger engages the sear at a trigger/sear engagement that defines a first length of engagement of the sear on the trigger and in the second position the trigger contacts a spring plunger while engaged with the sear at the trigger/sear engagement to define a second length of engagement of the sear on the trigger that is less than the first length of engagement, wherein the trigger is further movable in a second stage of movement from the second position against the spring plunger to disengage the trigger from the sear and allow the sear to pivot about the sear pivot to disengage the sear from the cocking-piece and release the cocking-piece; and a trigger spring biasing the trigger into engagement with the sear at the trigger/sear engagement during the first stage of movement, wherein the trigger spring is engaged to the trigger with a ball bearing and the trigger slides against the ball bearing during the first stage of movement and the second stage of movement.

19. The trigger assembly of claim 18, further comprising an adjusting screw engaged to the trigger body, wherein the trigger spring is adjustable with the adjusting screw to increase or decrease a trigger pull weight of the trigger during the first stage of movement.

20. The trigger assembly of claim 18, wherein the trigger includes a top end that defines a trigger arc and the sear defines a sear arc, and the trigger/sear engagement is created by frictional engagement between the trigger and the sear along the trigger arc and the sear arc.

21. The trigger assembly of claim 20, wherein the trigger arc and the sear arc slide on one another during the first stage of movement.

22. The trigger assembly of claim 20, wherein the first bearing area is defined by contact between the trigger and the sear along the trigger arc and the sear arc.

23. The trigger assembly of claim 18, wherein in the first position a first stage gap is defined between the trigger and the spring member so the trigger is not in contact with the spring member.

* * * * *